US007498559B2

(12) United States Patent
Nishimura et al.

(10) Patent No.: US 7,498,559 B2
(45) Date of Patent: Mar. 3, 2009

(54) OPTICAL DISCHARGE APPARATUS AND IMAGE FORMING APPARATUS CONTAINING THE SAME

(75) Inventors: Yasuhiro Nishimura, Nara (JP); Toshiaki Ino, Kyoto (JP); Mitsuru Tokuyama, Kyoto (JP); Kiyofumi Morimoto, Nara (JP); Takashi Kitagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 102 days.

(21) Appl. No.: 11/226,389

(22) Filed: Sep. 15, 2005

(65) Prior Publication Data

US 2006/0060751 A1 Mar. 23, 2006

(30) Foreign Application Priority Data

Sep. 22, 2004 (JP) ..... 2004-275713
Oct. 13, 2004 (JP) ..... 2004-299329

(51) Int. Cl.
*H01J 3/14* (2006.01)
*H01J 5/16* (2006.01)
*H01J 40/14* (2006.01)

(52) U.S. Cl. ..... 250/216; 399/51; 399/128; 399/177; 399/186; 399/191; 399/192

(58) Field of Classification Search ..... 250/216; 399/51, 128, 177, 186–192, 411, 216
See application file for complete search history.

(56) References Cited

U.S. PATENT DOCUMENTS 4,068,121 A * 1/1978 Bringhurst et al. ..... 250/227.28
4,534,641 A * 8/1985 Gilliland et al. ..... 399/187
4,561,761 A * 12/1985 Fox ..... 399/187
5,274,228 A * 12/1993 Kaplan ..... 250/227.31
5,499,112 A * 3/1996 Kawai et al. ..... 358/475

(Continued)

FOREIGN PATENT DOCUMENTS

JP 6-59856 8/1994

(Continued)

OTHER PUBLICATIONS

English translation of Kido, et al (JPO PN 2002-278395).*

(Continued)

*Primary Examiner*—David M Gray
*Assistant Examiner*—Geoffrey T Evans
(74) *Attorney, Agent, or Firm*—Nixon & Vanderhye P.C.

(57) ABSTRACT

In an optical discharge apparatus used in an electrographic image forming apparatus, by forming, on a light guiding member, a diffusing reflecting face for reflecting light from an LED lamp towards a photosensitive drum, and by supplementing the amount of light by altering the height of the diffusing reflecting face to the light emitting face and the width of the diffusing reflecting face in accordance with their distance from the light source, the light intensity distribution of the irradiating light that is irradiated onto the photosensitive drum is made uniform. An optical discharge apparatus may include a light guiding member arranged facing a photoreceptor; and a light source, a diffusing reflecting face for reflecting the light from the light source toward the photoreceptor is formed on the light guiding member, and a reflecting member is arranged on an upper face in the vicinity of an end portion of the light guiding member.

8 Claims, 23 Drawing Sheets

U.S. PATENT DOCUMENTS

| | | | | |
|---|---|---|---|---|
| 5,672,864 | A * | 9/1997 | Kaplan | 250/227.28 |
| 5,961,198 | A * | 10/1999 | Hira et al. | 362/621 |
| 5,969,343 | A * | 10/1999 | Nakamura et al. | 250/227.31 |
| 6,068,382 | A * | 5/2000 | Fukui et al. | 362/625 |
| 6,198,892 | B1 * | 3/2001 | Ohara | 399/128 |
| 2002/0172530 | A1 * | 11/2002 | Kido et al. | 399/128 |
| 2003/0210557 | A1 * | 11/2003 | Wu et al. | 362/555 |
| 2004/0062028 | A1 * | 4/2004 | Winston et al. | 362/31 |

FOREIGN PATENT DOCUMENTS

| | | |
|---|---|---|
| JP | 08-043633 | 2/1996 |
| JP | 10-133026 | 5/1998 |
| JP | 10-150526 | 6/1998 |
| JP | 10-190961 | 7/1998 |
| JP | 11-134918 | 5/1999 |
| JP | 2000-011723 | 1/2000 |
| JP | 2000-200049 | 7/2000 |
| JP | 2000-221853 | 8/2000 |
| JP | 2002-185708 | 6/2002 |
| JP | 2002-278395 | 9/2002 |
| JP | 2004-090050 | 3/2004 |

OTHER PUBLICATIONS

English translation of JPO pub # 08-043633.*

* cited by examiner (A)

FIG.23

| | supplement | angle $\theta$ | depth (mm) |
|---|---|---|---|
| Comparative Example 1 | reflecting film off | 0 | 0 |
| Working Example 1 | reflecting film on | 0 | 0 |
| Working Example 2 | reflecting film on | 75 | 1 |
| Working Example 3 | reflecting film on | 45 | 1 |
| Working Example 4 | reflecting film on | 15 | 1 |
| Working Example 5 | reflecting film on | 45 | to bottom edge |

OPTICAL DISCHARGE APPARATUS AND IMAGE FORMING APPARATUS CONTAINING THE SAME

BACKGROUND OF THE INVENTION

This application claims priority under 35 U.S.C. § 119(a) on Patent Application No. 2004-275713 filed in Japan on Sep. 22, 2004, and on Patent Application No. 2004-299329, filed in Japan on Oct. 13, 2004, the entire contents of which are hereby incorporated by reference.

The present invention relates to optical discharge apparatuses for removing residual electric charges on photosensitive bodies by irradiating light, and to image forming apparatuses such as copier machines provided with same, in electrographic image forming processes.

As electrographic image forming apparatuses such as copier machines, there exist monochrome image forming apparatuses for forming black and white images, and color image forming apparatuses for forming color images. For color image forming apparatuses, there are multi-rotational image forming apparatuses for sequentially forming a toner image of composite colors onto a single photoreceptor via toner image forming means for each color (black, cyan, magenta and yellow), and tandem-type image forming apparatuses in which a plurality of toner forming means that form, substantially simultaneously, a toner image of the color components onto individual photosensitive bodies, are aligned along the transport direction of an intermediate transfer material.

Such electrographic image forming apparatuses are apparatuses that form images by the processes of charging, exposing, developing, transferring and fixing, and in the case of copier machines for example, the aforementioned processes are performed in the following manner.

First, an electrostatic latent image is formed on the surface of a photoreceptor (a photosensitive drum) that has been given a uniform potential by an electrostatic charger, by exposing the light reflected from the original image via an optical system. Toner (developer) is then electrostatically fixed to the electrostatic latent image to form a toner image on the photoreceptor. Next, an electrostatic charge having a polarity that is opposite to that of the toner image is applied to the transferring body so as to transfer the toner image onto recording paper, and an image according to the original image is fixed onto the recording paper by applying heat and pressure to the transferred toner.

A large number of functional elements are added to the basic configuration of a copier machine that is constituted as above, for the purpose of improving image quality and improving the efficiency of the facsimile image formation. One such element, for example, is an optical discharge apparatus for charge removal an electric charge on a photoreceptor using irradiating light. Optical discharge apparatuses include devices such as an eraser for erasing poor latent images from a non-image region on the photoreceptor before developing, a pre-transfer charge removal lamp (PTL) that optically reduces the electric potential on the photoreceptor before transfer, and a charge removal lamp (QL) for removing the residual charge on the photoreceptor after cleaning.

Electrical discharge tubes such as fluorescent tubes are used as the illuminating source for such optical discharge apparatuses. Furthermore, as shown in FIG. 29, an LED array 500 in which a plurality of LED chip 502 is arranged on a substrate 501 may be used. In particular, since smaller, cheaper products have been in demand in recent years, there has been an increase in the number of devices making use of this type of LED array 500.

As shown in FIG. 30, the LED array 500 is densely arranged with rows of LED chips (LED lamps) 502 so that it is possible to achieve a substantially uniform, high degree of illumination on the surface of a photosensitive drum 401, which is the illuminated surface.

However, with this configuration, since the number of LED ships 502 is large, it has been difficult to achieve sufficient reductions in cost. Also, when the number of LED chips that are used is decreased in order to achieve lower costs, the interval between LED chips 502 increases, inconsistencies have developed in the distribution of the illumination on the photosensitive drum 401. Thus it has not been possible to achieve a consistent degree of illumination.

As a technique to solve such problems, an illuminating device has been disclosed that is provided with a light source on an end portion of a light guiding member, the light guiding member having a light illuminating face that is a column-shaped member made from a transparent material that is provided with a side face portion extending in the long direction, and a light diffusing portion made by cutting or surface roughening, provided on a surface that opposes the light illuminating portion (See JP H8-043633A, for example).

Furthermore, an optical discharge apparatus is proposed that is provided with a point light source that is provided on a main body of an image forming apparatus, and an optical guiding body for guiding light from the point light source to the photoreceptor, mounted on a process cartridge that can be freely coupled and uncoupled to and from the main body of the image forming apparatus (see JP 2002-278395A, for example).

However, with the configurations described in aforementioned patent references, there still remains the problem that, of those regions of the photosensitive drum that are illuminated by the light from the optical guiding body, more light illuminates the regions closer to the light source, and less light illuminates those regions that are further removed from the light source. When there are inconsistencies in the distribution of the amount of illuminating light in the length direction of such a photosensitive drum, image inconsistencies and the like may occur, and it may be impossible to achieve a good image. In particular, in the vicinity of the trailing edge portion of the optical guiding body, which is furthest from the light source, there is a large degree of loss of illuminating light, and there is a need for improvement of this point.

The present invention has been achieved with consideration to such facts, and it is an object of the present invention to provide, in an electrographic image forming apparatus, an optical discharge apparatus that is capable of providing a more uniform distribution of light that is irradiated onto a photoreceptor to remove an electric charge on the photoreceptor, and to provide an image forming apparatus that is provided with an optical discharge apparatus that has such characteristics.

SUMMARY OF THE INVENTION

The optical discharge apparatus of the present invention is used for removing an electric charge on a photoreceptor in an electrographic image forming apparatus, and is characterized by a light guiding member arranged facing the photoreceptor, and a light source for irradiating light onto a light incident face of the light guiding member, wherein a diffusing reflecting face for reflecting the light from the light source toward the photoreceptor is formed on the light guiding member, and the height of the diffusing reflecting face to the light emitting face for emitting light from the light guiding member onto the photoreceptor and the width (length in the direction that is perpendicular to the length direction of the photoreceptor) of the diffusing reflecting face, change in accordance with distance from the light source, and wherein a reflecting member is arranged on an upper face in the vicinity of an end portion of the light guiding member.

With the optical discharge apparatus of the present invention, there is a light guiding member on which a diffusing reflecting face for reflecting light from a light source toward the photoreceptor is formed, and since the height from the diffusing reflecting face of the light guiding member to the light emitting face for emitting light to the photoreceptor and the width of the diffusing reflecting face, change in accordance with the distance from the light source, it is possible to make the light intensity distribution of irradiated light that is irradiated onto the photoreceptor even more uniform.

A reflecting member is arranged on an upper face on the vicinity of an end portion of the light guiding member, and thus it is possible to increase the amount of the irradiating light that is irradiated onto the photoreceptor from the vicinity of the end portion of the light guiding member by the reflection of light at the reflecting member. Thus it is possible to make the intensity distribution of the irradiating light even more uniform.

The optical discharge apparatus of the present invention is used for removing an electric charge on a photoreceptor in an electrographic image forming apparatus, and is characterized by including a light guiding member arranged facing the photoreceptor, and a light source for irradiating light onto a light incident face of the light guiding member, wherein a diffusing reflecting face for reflecting the light from the light source toward the photoreceptor is formed on the light guiding member, and the height of the diffusing reflecting face to the light emitting face for emitting light from the light guiding member onto the photoreceptor and the width of the diffusing reflecting face, change in accordance with distance from the light source, and wherein a groove that cuts across the light guiding member is formed on an upper face in the vicinity of an end portion of the light guiding member.

With the optical discharge apparatus of the present invention, there is a light guiding member on which a diffusing reflecting face for reflecting light from a light source toward the photoreceptor is formed, and since the height from the diffusing reflecting face of the light guiding member to the light emitting face for emitting light to the photoreceptor, and the width of the diffusing reflecting face change in accordance with the distance from the light source, it is possible to make the light intensity distribution of irradiated light that is irradiated onto the photoreceptor even more uniform.

Since the groove that cuts across the light guiding member is formed on the upper face in the vicinity of the end portion of the light guiding member, it is possible to increase the amount of the irradiating light that is irradiated onto the photoreceptor from the vicinity of the end portion of the light guiding member by the reflection of light at the reflecting member, and it is possible to make the intensity distribution of the irradiating light even more uniform.

In the aforementioned configuration, the reflecting member may also be arranged on the upper face in the vicinity of the end portion of the light guiding member, and on an interior face of the groove that cuts across the light guiding member.

As described above, provided that the reflecting member is arranged on the upper face in the vicinity of the end portion of the light guiding member, and on the interior face of the groove that cuts across the light guiding member, it is possible to further increase the intensity of the irradiating light from the vicinity of the end portion of the light guiding member, and to further improve the uniformity of the intensity distribution of the irradiating light.

Moreover, the optical discharge apparatus of the present invention is used for removing an electric charge on a photoreceptor in an electrographic image forming apparatus, and is characterized by including a light guiding member arranged facing the photoreceptor, and a light source for irradiating light onto a light incident face of the light guiding member, wherein a diffusing reflecting face for reflecting the light from the light source toward the photoreceptor is formed on the light guiding member, and the height of the diffusing reflecting face to the light emitting face for emitting light from the light guiding member onto the photoreceptor and the width of the diffusing reflecting face, change in accordance with distance from the light source, and wherein an end portion of the light guiding member has a steep inclined face.

The light charge removal device of the present invention is provided with a light guiding member on which a diffusing reflecting face for reflecting light from a light source toward the photoreceptor is formed, and a light source for irradiating the light onto a light incident face of the light guiding member, wherein the light diffusing reflecting body for reflecting the light from the light source toward the photoreceptor is formed on the light guiding member. Since the height from the diffusing reflecting face of the light guiding member to the light emitting face for emitting light onto the photoreceptor, and the width of the diffusing reflecting face change in accordance with the distance from the light source, it is possible for the diffusing reflecting face to make the light intensity distribution of irradiated light that is irradiated onto the photoreceptor even more uniform.

Since the end portion of the light guiding member has a steep inclined face, the reflection of the light at the steep inclined face allows the intensity of the irradiating light that is irradiated onto the photoreceptor from the vicinity of the end portion of the light guiding member to increase, and the light intensity distribution of the irradiating light can be made more uniform.

In the aforementioned configuration, the reflecting member may also be arranged on an upper face in the vicinity of the end portion of the light guiding member, and on the steep inclined face.

In this case, provided that the reflecting member is arranged on the upper face in the vicinity of the end portion of the light guiding member, and on the steep inclined face, it is possible to further increase the intensity of the irradiating light from the vicinity of the end portion of the light guiding member, and to further improve the uniformity of the light intensity distribution of the irradiated light.

Furthermore, in the aforementioned configuration, the light guiding member is folded, and it is also possible to provide a reflecting face for the purpose of bending the light path of the light guiding member in the folding location of the light guiding member.

In this case, the light guiding member is folded, and since the reflecting face is provided in the location at which the light guiding member is folded, for the purpose of bending the light path of the light guiding member, the length of the light path of the charge removal region can be lengthened without increasing the length of the light guiding member in the direction of the optical axis. As a result, it is possible to achieve a reduction in the size of the image forming apparatus.

Furthermore, the optical discharge apparatus of the present invention is used for removing an electric charge on a photoreceptor in an electrographic image forming apparatus, and is characterized by including a light guiding member arranged facing the photoreceptor, and a light source for irradiating light onto a light incident face of the light guiding member, wherein a diffusing reflecting face for reflecting the light from the light source toward the photoreceptor is formed on the light guiding member, a rear end face of the light guiding member is an optically transparent face, and a reflecting face is arranged behind the rear end face of the light guiding member.

With the optical discharge apparatus of the present invention, since the rear end face of the light guiding member is an optically transparent face, and a reflecting face is arranged behind the rear end face of the light guiding member, it is possible to reflect the light that passes through the rear end portion of the light guiding member toward the light guiding member, and to increase the intensity of the irradiating light that is irradiated onto the photoreceptor from the vicinity of the rear end portion of the light guiding member. As a result, it is possible to make the light intensity distribution of the irradiating light that is irradiated onto the photoreceptor more uniform.

Here, it is possible to consider methods in which the reflecting tape is fixed directly to the rear end portion of the light guiding member, or aluminum vapor deposition is performed on the rear end face, as methods for increasing the amount of light that is irradiated in the vicinity of the rear end portion of the light guiding member, however, in these methods, since the light guiding member is elongated, there is the problem of poor workability when carrying out the process of attaching the reflecting tape, or performing aluminum vapor deposition. Furthermore, there are also problems due to inconsistencies in the state of the rear end face of the light guiding member, and worsening of the reflectance due to the presence of, for example, an adhesive layer on the rear end face. Thus, as with the present invention, workability is improved by arranging the reflecting face in a separated state behind the rear end face of the light guiding member to remove the necessity of working the light guiding member itself. Moreover, by separating the reflecting face from the light guiding member, it is possible to ensure a high reflectance without being affected by the state of the surface of the rear end portion of the light guiding member.

Furthermore, in the aforementioned configuration, the reflecting member that has the reflecting face may also be formed as a single piece with the supporting member that supports the rear end portion of the light guiding member.

If such a configuration is employed, then it is possible to maintain the positional relationship of the rear end portion of the light guiding member at a constant to the reflecting face behind it, and thus it is possible to ensure a reliable reflectance without fluctuations. By forming the reflecting member as a single piece with the supporting member, it is also possible to reduce the number of components.

Furthermore, in the aforementioned configuration, the reflecting face that is arranged behind the rear end face of the light guiding member may also be formed from a metal thin film by vapor deposition of a metal, for example. In this case, the metal material may be aluminum, but with consideration to the corrosivity, for example, of the ozone that is generated by the charger and the like, it is preferable to use nickel, chromium, nickel-chromium alloy or gold.

In the aforementioned configuration, it is preferable that the diffusing reflecting film of the light guiding member has a shape such that the height of the light emitting face of the light guiding member for emitting light onto the photoreceptor, and the width of the diffusing reflecting face, change in accordance with the distance from the light source. By altering the height of the diffusing reflecting face of the light guiding member to the light emitting face that emits light onto the photoreceptor, and the width of the diffusing reflecting face, in accordance with the distance to the light source to compensate the amount of light in this way, it is possible to make the light intensity distribution of the irradiating light that is irradiated onto the photoreceptor more uniform.

In the aforementioned configuration, by pasting a reflecting film (for example, a polycarbonate film on which nickel vapor deposition has been performed) onto an opposing face that faces the rear end face of the light guiding member of a reflecting member that is formed in a single piece with the supporting member (including a face that contacts the rear end face), the reflecting face may be formed behind the rear end face of the light guiding member, and the reflecting film (metal thin film) may be formed on the opposing face of the supporting member by direct vapor deposition of a metal such as nickel, chromium, nickel-chromium alloy or gold. If the reflecting member is constituted by a metal, then the reflecting face may be formed by mirror polishing the opposing face that faces the rear end portion of the light guiding member.

The image forming apparatus of the present invention is characterized by the provision of an optical discharge apparatus having the above-mentioned characteristics.

Furthermore, in the aforementioned configuration, if a corona charging unit is provided as the charger for charging the surface of the photoreceptor, then the light guiding member may be supported on the case of the corona charging unit via a supporting member.

With a structure in which the case of the corona charging unit supports the light guiding member in this manner, it is possible to decrease the amount of the installed space of the light guiding member. In particular, if the image forming apparatus is a color tandem-type, then although the installed space of the light guiding bodies (occupied space) has conventionally been an impediment to achieving miniaturization, if the case of the corona charging unit supports the light guiding member then it is possible to reduce each of the installed spaces of the light guiding bodies in the image forming portion (image station) corresponding to each color, and thus the size of the entire apparatus may be greatly reduced.

Furthermore, in the aforementioned configuration, an opening portion for letting air out of the case of the corona charging unit is provided, and the light guiding member may be supported in a position higher than the opening portion.

In this case, the adverse effects on the light guiding member of ozone generated within the case of the charger can be prevented. That is to say, the ozone that is generated by corona discharge is removed downward through the opening portion by its own weight, and so by arranging the light guiding member in a position that is higher than the opening portion of the case, it is possible to prevent the ozone from degrading (such as corroding), the diffusing reflecting face of the light guiding member, and the reflecting face of the reflecting member, for example.

Moreover, in this case, it is also possible to forcibly exhaust the air containing the ozone by providing exhaust means, such as an exhaust duct and exhaust fan for exhausting the air containing the ozone generated in the case of the corona charging unit.

Furthermore, for the image forming apparatus of the present invention, an image forming apparatus in which image forming portions that each include a photoreceptor are aligned in tandem is characterized in that the optical discharge apparatus of the present invention is attached to each of the photosensitive bodies As described above, with the image forming apparatus of the present invention, an optical discharge apparatus having the aforementioned characteristics is provided on each photoreceptor of the image forming portions that are lined up in tandem. In order to reduce the size of such an image forming apparatus, it is necessary to reduce the size of the image forming portions, and thus it is preferable to apply a device that is small as the photo charge removal device of the image forming portions. The optical discharge apparatus having the aforementioned characteristics has a simple configuration, namely a light guiding member that is arranged to face the photoreceptor, and a light source for irradiating light onto a light incident face of the light guiding member, and thus miniaturization is possible. Consequently, since it is also possible to miniaturize the image forming portions, thus it is possible to achieve the effect of miniaturizing the image forming device.

As in the aforementioned description, since the image forming apparatus of the present invention is provided with the optical discharge apparatus of the present invention, it is possible to obtain high quality images.

BRIEF DESCRIPTION OF DRAWINGS

FIG. 23 is a table showing the specification of each of the rear end portions of the light guiding member of Comparative Example 1 and Working Examples 1 to 5.

DESCRIPTION OF THE PREFERRED EMBODIMENTS

Embodiments of the present invention are described below with reference to the drawings.

Embodiment 1

Image Forming Apparatus

Figure 1:
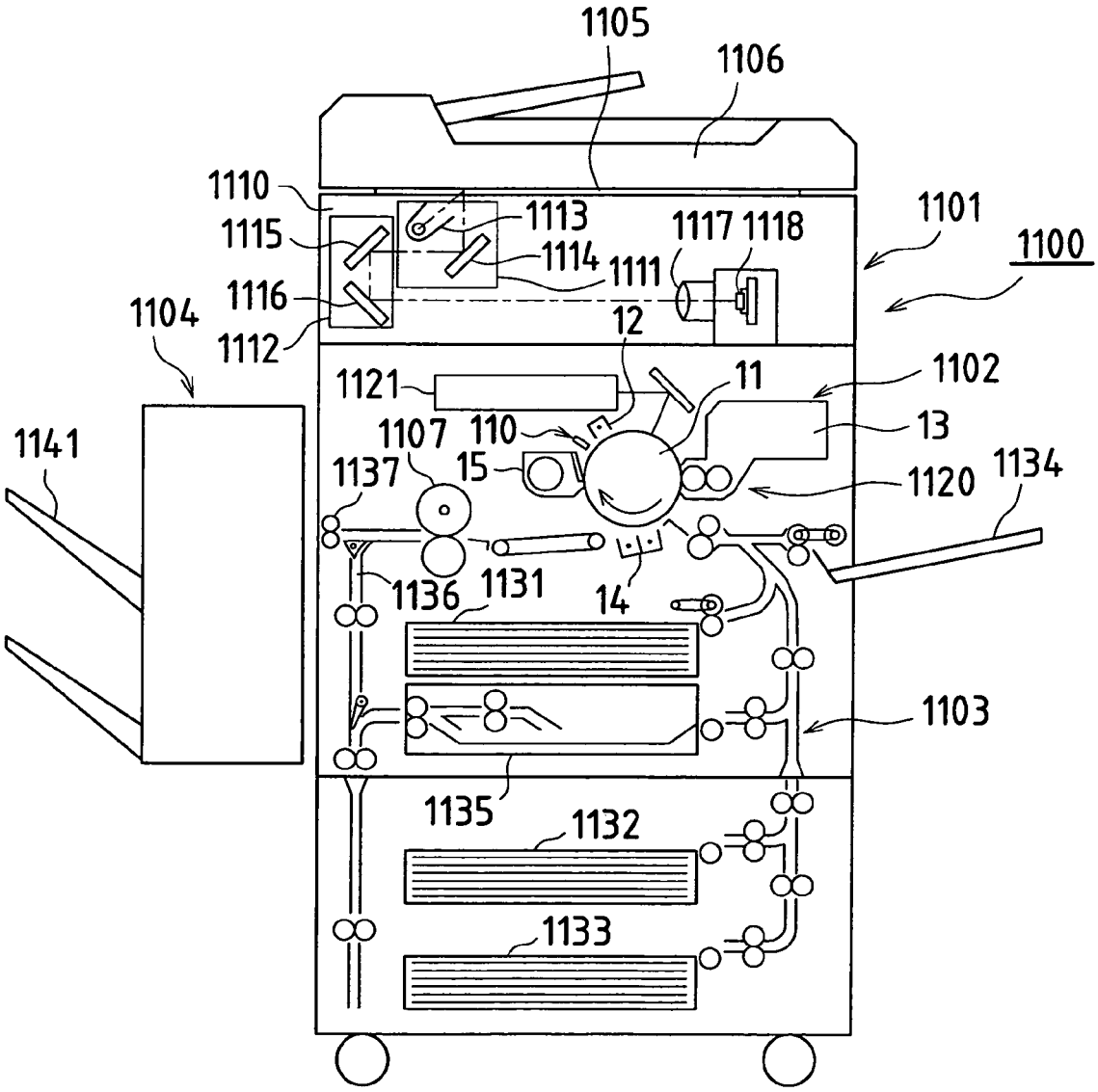
FIG. 1 is view showing a configuration of an image forming apparatus according to Embodiment 1 of the present invention.

FIG. 1 is a view showing an image forming apparatus according to Embodiment 1 of the present invention.

An image forming apparatus 1100 of the present example is a digital combined machine that is capable of operating as a facsimile, a copier, and a printer, and it is provided with an image reading portion 1101, an image forming portion 1102, a paper feed portion 1103 and a post-processing device 1104.

The image forming portion 1101 is provided as an image input device of the image forming apparatus 1100 for the purpose of reading images from a document, or the like. In addition to a document platen 1105 made of transparent glass, the image forming portion 1101 is provided with a reverse-side automated document feeder (hereinafter referred to as an "RADF") and an optical unit 1110.

The image reading portion 1101 sequentially reads in, page by page, images from a document that is placed on the document platen 1105. The RADF 1106 transports documents set in a predetermined document tray, page by page, to the document platen 1105, and after the images are read by the optical unit 1110, returns them to a predetermined discharge position.

The optical unit 1110 is constituted as a document image reading unit for reading images of the documents that are transported to the document platen 1105 in predetermined units in a scanning direction. The optical unit 1110 is provided with a first mirror base 1111, a second mirror base 1112, an optical lens 1117 and a photoelectric transducer (hereinafter referred to as a CCD) 1118.

The first mirror base 1111 is provided with a lamp reflector assembly 1113 for irradiating light, and a first reflecting mirror 1114 that guides the reflected light from the document to the second mirror base 1112, which will be described below. The first mirror base 1111 moves along the document platen 1105 at a constant velocity V from left to right in the drawing while irradiating the document with light.

The second mirror base 1112 is provided with a second reflecting mirror 1115 and a third reflecting mirror 1116 that guide the light from the first mirror base 1111 in the direction of the optical lens 1117 and the CCD 1118, and the second mirror base tracks the movement of the first mirror base 1111 and moves at a velocity of V/2.

The optical lens 1117 forms an image of the light reflected by the second mirror base 1112 on the CCD 1118. The CCD 1118 then converts the light that is formed into an image by the optical lens 1117 into an electric signal. The analog electric signal that is obtained by the CCD 1118 is converted to a piece of digital signal image data and then, after various image processing, is transferred to the image forming portion 1102 via appropriate buffer memory, or the like.

The image forming portion 1102 has an image forming unit 1120 and an exposure unit 1121. The exposure unit 1121 exposes the photosensitive drum 11 with light in accordance with image data read out from the buffer memory, or image data that is transferred from an external device. Although not shown, the exposure unit 1121 is provided with a semiconductor laser light source for emitting laser light, a polygon mirror for polarizing the laser light at a constant angular velocity, and an f-θ lens, for example, for further polarizing the light from the polygon mirror, and for moving the laser light along the photosensitive drum 11 at a constant velocity.

Figure 2:
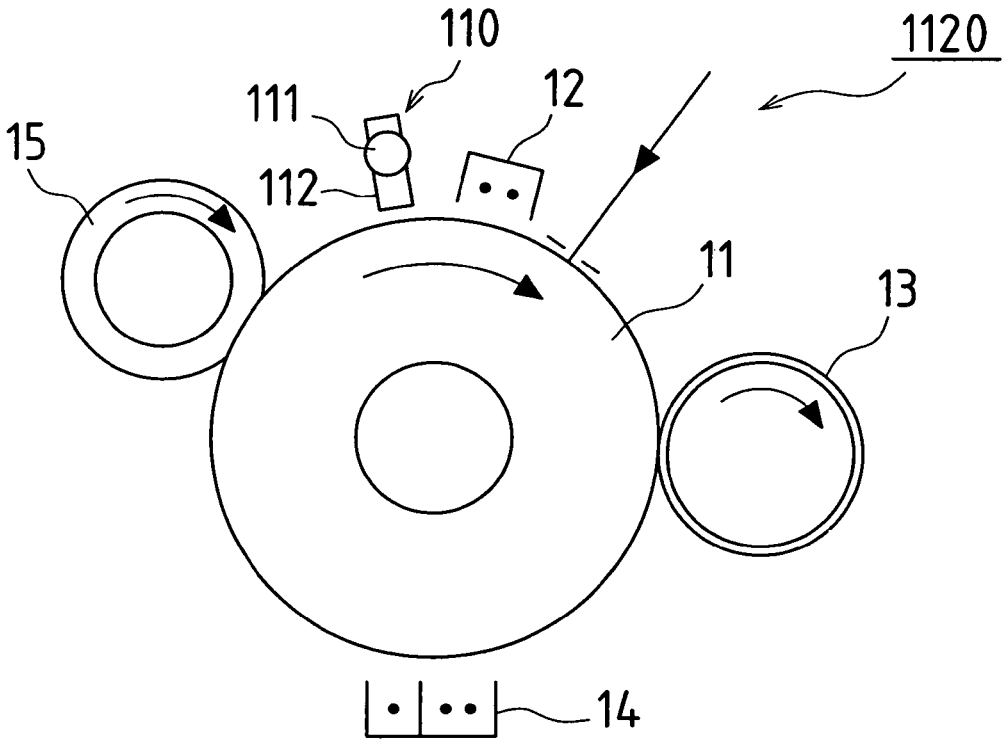
FIG. 2 is a view showing a configuration of an image forming unit used in the image forming apparatus of FIG. 1.

As shown in FIG. 2, the image forming unit 1120 is provided with the photosensitive drum 11 that supports the electrostatic latent image. A charger 12 for charging a predetermined potential onto the surface of the photosensitive drum 11, a developing device 13 for providing toner to the electrostatic latent image formed on the surface of the photosensitive drum 11 by the exposure unit 1121 to develop the image, a transfer device 14 for transferring the toner image on the surface of the photosensitive drum 11 to paper, a cleaning device 15 for cleaning the surface of the photosensitive drum 11, and an optical discharge apparatus 110 for removing the residual electric charge from the photosensitive drum 11 are arranged in this order in the vicinity of the photosensitive drum 11, wherein the processes of charging, exposing, developing, transferring, cleaning and charge removal are performed at the surface of the photosensitive drum 11. It should be noted that the transferred toner image (the image) is thermally fixed to the paper on which the predetermined image forming process is performed by the image forming unit 1120, by a fixing device 1107 that is arranged downstream from the image forming unit 1120, and is discharged by a paper discharge roller 1137.

A switchback carry path 1136 for reversing the paper for the purpose of forming images on both sides of the paper, and an elevating tray 1141, are provided on the downstream side of the image forming unit 1120 and the fixing device 1107, as is the post processing device 1104 for stapling, for example, the paper on which the image is formed.

The paper delivery portion 1103 is arranged below the image forming unit 1120, and is provided with a manual feed tray 1134, a two-sided unit 1135, a multiple paper feed unit made from paper cassettes 1131, 1132 and 1133, and transporting means for transporting the paper from these paper containing portions (1131 to 1134) to the image forming unit 1120. It should be noted that the two-sided unit 1135 is used when forming images onto both side of the paper, the paper passing through the switchback carry path 1136.

Optical Discharge Apparatus

Next, the optical discharge apparatus 110 according to Embodiment 1 of the present invention will be described.

Figure 3:
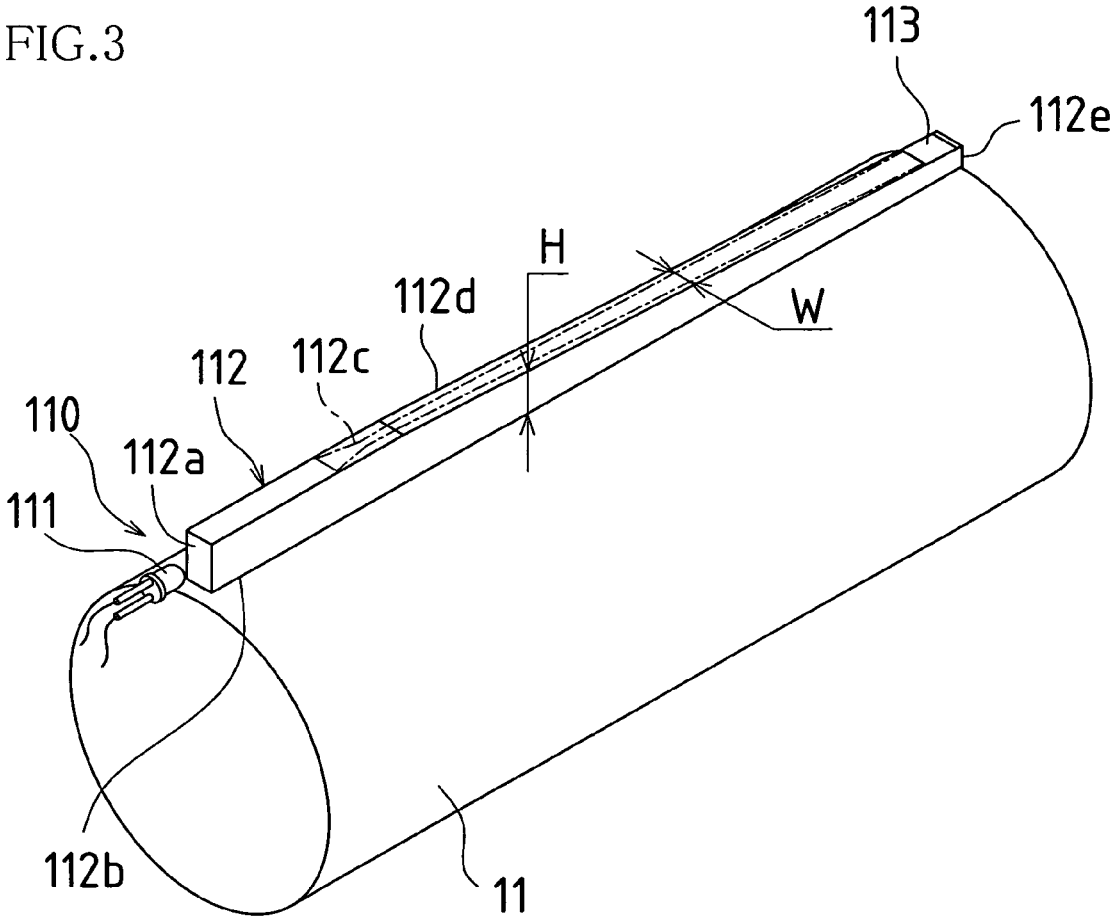
FIG. 3 is a perspective view showing the principle structures of an optical discharge apparatus according to Embodiment 1 of the present invention.
Figure 4:
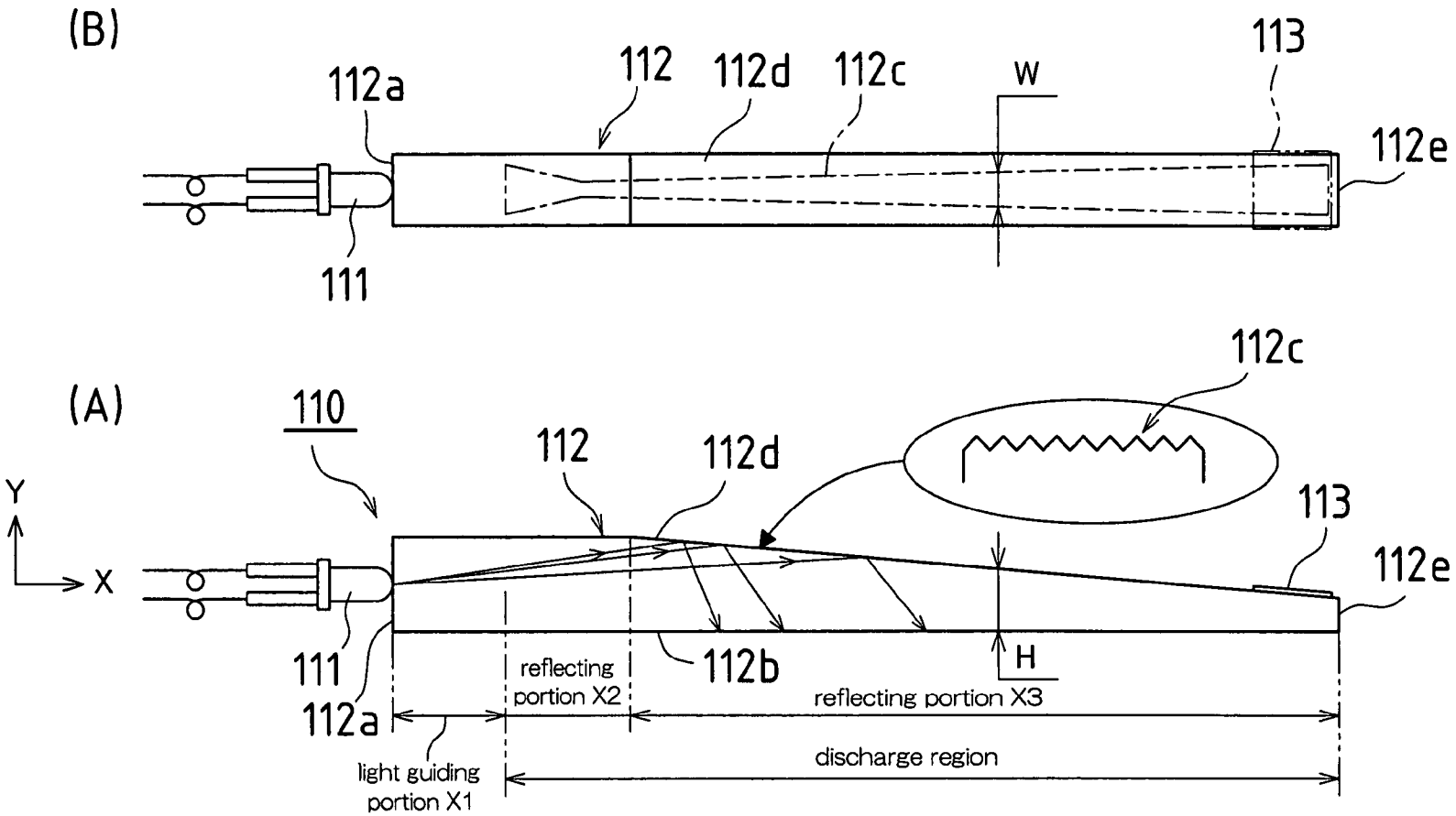
FIG. 4 is a view of showing both a lateral view A and a plan view B of the optical discharge apparatus of FIG. 3.
Figure 5:
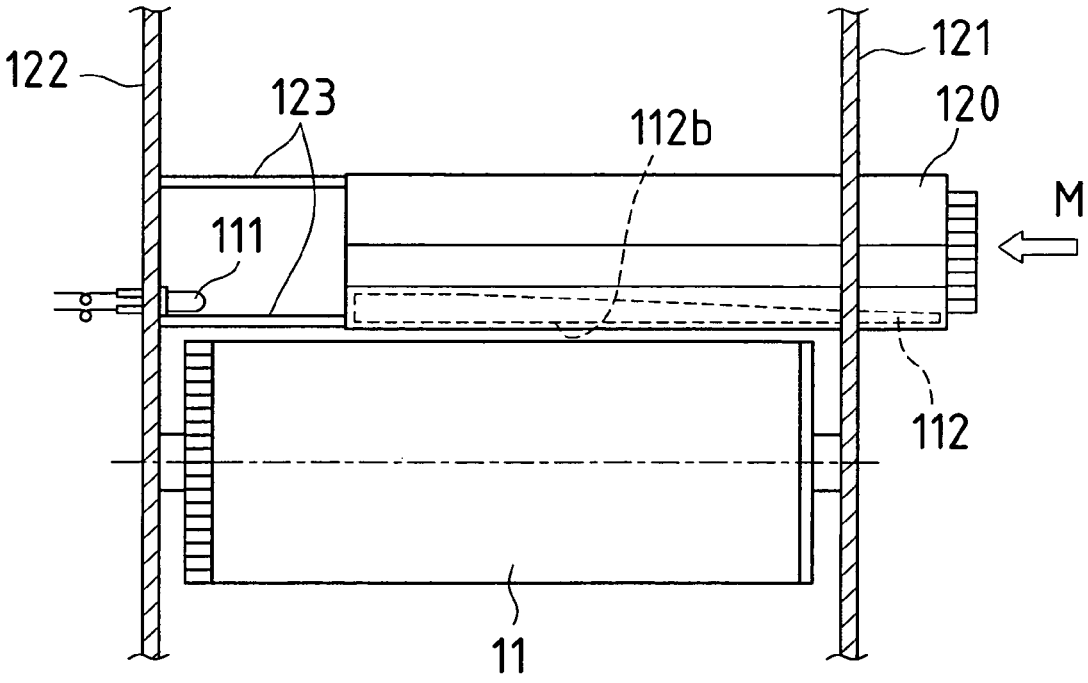
FIG. 5 is a view showing how the optical discharge apparatus of FIG. 3 is coupled to the image forming apparatus.
Figure 5:
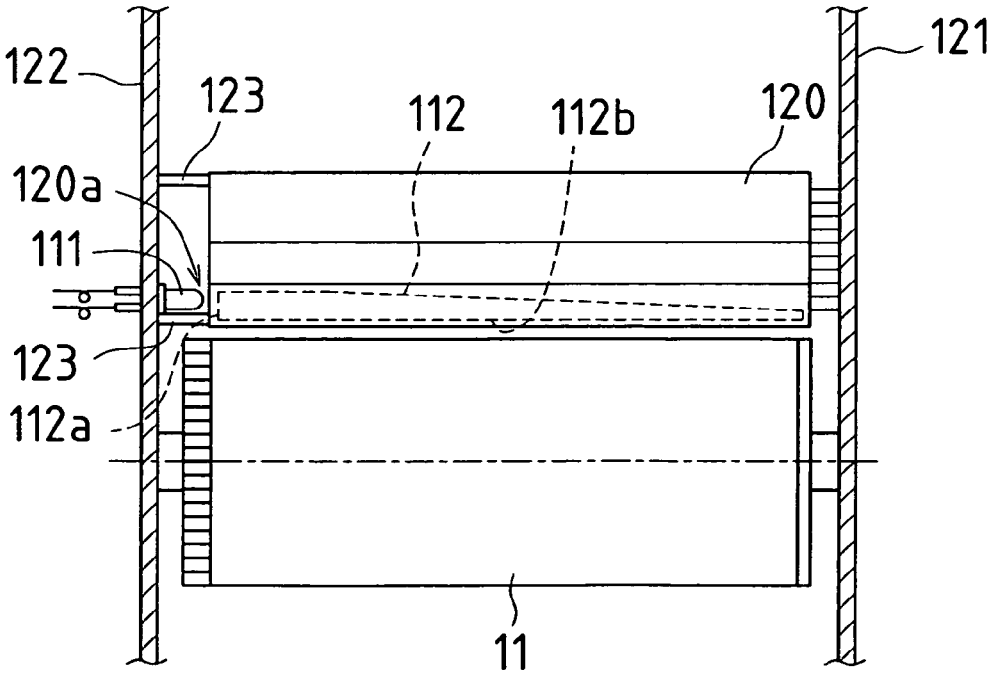

The optical discharge apparatus 110 is provided with an LED lamp 111, which is a point light source, and a light guiding member 112 (made of an optically transparent material), as shown in FIG. 3 to FIG. 5.

As shown in FIG. 5A and FIG. 5B, the light guiding member 112 is mounted in a process cartridge 120. The process cartridge 120 can be freely coupled and detached by sliding along cartridge guide members 123 that are attached on a front face frame 121 and back face frame 122 of the main unit of the image forming apparatus 1100.

The LED lamp 111 is arranged opposite an end portion 120*a* that is on the front end side, in the mounting direction of the process cartridge 120 indicated by an arrow M, in a non-image forming region of the photosensitive drum 11.

As shown in FIG. 3 and FIG. 4, the light guiding member 112 is a belt-shaped member that extends in a direction that is parallel to the photosensitive drum 11, and the face that faces the photosensitive drum 11 is a light emitting face 112*b*. One of the end faces (end surface) in the length direction of the light guiding member 112 is a light incident face 112*a*, and the light incident face 112*a* is opposite the LED lamp 111.

The light guiding member 112 forms a light guiding path X1 that is an optical guide path for the light from the LED lamp 111, and a reflecting portion X2 and a reflecting portion X3 that constitute a charge removal region.

The reflecting portion X2 is formed into a shape in which the light emitting face 112*b* and its rear face 112*d* are parallel. The reflecting portion X3 is processed into a shape in which the rear face 112*d* is inclined toward the light emitting face 112*b*, and the rear face 112*d* is shaped such that it approaches the light emitting face 112*b* in the direction of a rear end face 112*e* of the light guiding member 112.

The region, corresponding to the reflecting portion X2 and the reflecting portion X3, on the rear face 112*d* of the light guiding member 112 is formed as a diffusing reflecting face (prism face) 112*c* for reflecting the light from the LED lamp 111 toward the photosensitive drum 11. In the light reflecting portion X2, a height H of the diffusing reflecting face 112*c* to the light emitting face 112*b* is constant. In the reflecting portion X3, the height H of the light emitting face 112*b* to the diffusing reflecting face 112*c* in the light emitting portion X2 decreases toward the end face portion of the reflecting portion X3 (rear end face portion 112*e* of the light guiding member 112). Moreover, a width W of the diffusing reflecting face 112*c* (length in a direction that is perpendicular to the axial direction of the photosensitive drum 11) is not constant, but, as shown in FIG. 4B, is formed in a pattern in which the width reduces from the end portion of the light receiving side of the reflecting portion X2 toward the reflecting portion X3, and then the width widens from within the reflecting portion X2 extending toward the rear end portion of the reflecting portion X3 (the rear end face 112*e* of the light guiding member 112).

Furthermore, a reflecting film 113 on which aluminum vapor deposition, or the like, has been performed is pasted onto the diffusing reflecting surface 112*c* in the vicinity of the rear end portion of the light guiding member 112. Although the light is substantially reflected by the prism face of the diffusing reflecting face 112*c*, a small amount of light passes through and leaks to the outside. The reflecting film 113 reflects the light that leaks from the diffusing reflecting face 112*c* and returns the reflected light to the interior of the light guiding member 112 via the diffusing reflecting face 112*c*.

As described above, for the light guiding member 112 of the present example, the height H (length in the Y direction) of the diffusing reflecting face 112*c* that reflects the light from the LED lamp 111 toward the photosensitive drum 11, to the light emitting face 112*b*, changes with the distance to the LED lamp 111 (position in the X direction), and the width W of the diffusing reflecting face 112*c* also changes with the distance to the LED lamp 111 (position in the X direction). Thus it is possible to provide a uniform light intensity distribution of irradiated light onto the photosensitive drum, across the entire region in the axial direction (length direction) of the photosensitive drum 11.

By pasting the reflecting film 113 on the diffusing reflecting face 112*c* in the vicinity of the rear end portion of the light guiding member 112, and reflecting, with the reflecting film 113, the light that leaks out from the diffusing reflecting face 112*c* to return the light to the interior of the light guiding member 112, thus it is possible to increase the amount of the light emitted from the light emitting face 112*b* in the vicinity of the rear end portion of the light guiding member 112, and to make the distribution of the emitted light even more uniform.

As a result, it is possible to achieve high quality images that have no image inconsistencies or the like.

Here, excluding indentations of the prism face, for example, that are formed on the diffusing reflecting face 112*c*, all the faces of the light guiding member 112 used as the optical discharge apparatus 110 of the present example are smooth. The light guiding member 112 is fabricated by molding a transparent material such as acrylic resin, polycarbonate resin, polystyrene resin, polyvinyl chloride resin or glass by injection molding or extrusion molding, and then grinding, for example, where necessary. Or, the light guiding member 112 may also be fabricated by making all its surfaces smooth, and attaching a piece of cloudy white diffusing tape only over the part that is to be the diffusing reflecting face 112*c*, and pasting the reflecting film 113 in the vicinity of the rear end portion of the light guiding member 112, overlapping the piece of white cloudy diffusing tape.

The LED lamp 111 used in the optical discharge apparatus 110 of the present example may be fabricated by, for example, bonding an LED chip onto a metal lead and sealing that part into a lens shape made from a transparent resin, and then arranging this in the vicinity of the light incident face 112*a* of the light guiding member 112. For the LED lamp 111, it is possible to suggest a super high intensity LED lamp, with, for example, a wavelength of 618 nm and a test resistance of 200 Ω (manufactured by Sharp, product code: GL 5ZJ43).

It should be noted that an image forming apparatus for forming monochromatic images from a single image forming portion 1102 is disclosed here, but it is also possible to apply the optical discharge apparatus 110 to a color image forming apparatus. In a color image forming apparatus, each color forming portion is arranged in tandem in the separate colors of black, magenta, cyan and yellow, for example, and the image of each color is formed by direct layering onto the recording paper by the image forming portions, or the image is formed by layering the image of each color onto the recording paper via an intermediate belt. In order to miniaturize such a color image forming apparatus, it is necessary to make each image forming portion more compact, and thus it is preferable to utilize a member that is small to be the optical discharge apparatus of the image forming portions. Since the optical discharge apparatus 110 described above is configured simply from the light guiding member 112 arranged facing the photosensitive drum 11, and the LED lamp 111 that irradiates light onto the light incident face of the light guiding member 112, it is possible to achieve miniaturization. Accordingly, it is also possible to achieve more compact image forming portions, and to realize a miniaturized color image forming apparatus.

Embodiment 2

Figure 6:
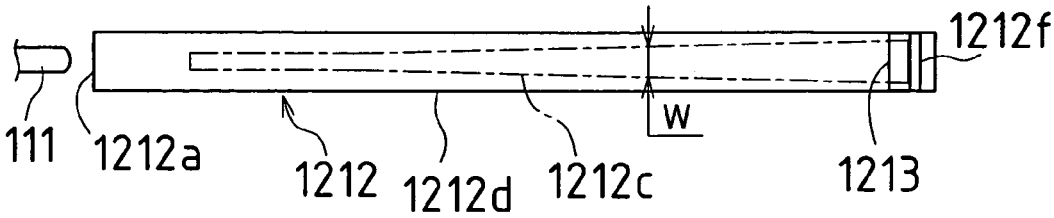
FIG. 6 is a view showing both a lateral view A and a plan view B, that show the optical discharge apparatus according to Embodiment 2 of the present invention.
Figure 6:
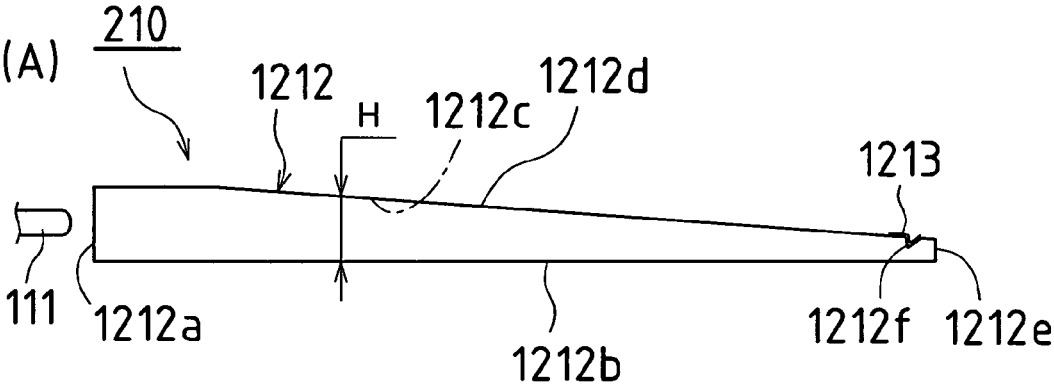

An optical discharge apparatus according to Embodiment 2 of the present invention is shown in FIG. 6A and FIG. 6B.

An optical discharge apparatus 1210 is provided with a light guiding member 1212 that is arranged opposite the photosensitive drum 11 (see FIG. 3), and an LED lamp 111 that irradiates light onto a light incident face 1212*a* of the light guiding member 1212.

A reverse side 1212*d* of the light guiding member 1212 is substantially an inclined face, and a diffusing reflecting face (prism face) 1212*c* is formed on the inclined face for reflecting the light from the LED lamp 111 in the direction of the photosensitive drum 11.

The diffusing reflecting face 1212*c* of the light guiding member 1212 is formed such that the height H to a light emitting surface 1212*b*, and a width W of the diffusing reflecting face 1212*c* (the length in a direction perpendicular to the axial direction of the photosensitive drum 11) decrease at a constant rate toward a rear end face 1212*e* of the light guiding member 1212, in accordance with a distance from the LED lamp 111.

Figure 7:
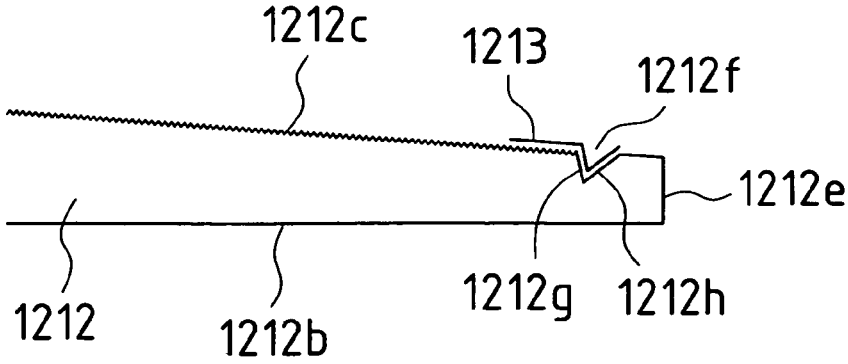
FIG. 7 is a lateral view showing an enlargement of the vicinity of the trailing edge of the light guiding member of FIG. 6.

Furthermore, as shown enlarged in FIG. 7, a V-shaped groove 1212*f* that cuts across the light guiding member 1212 is formed in the vicinity of the rear end portion of the light guiding member 1212 and a reflecting film 1213 on which aluminum vapor deposition has been performed is pasted onto the diffusing reflecting face 1212*c* and faces 1212*g* and 1212*h* of the V-shaped groove 1212*f* in the vicinity of the rear end portion of the light guiding member 1212. For the diffusing reflecting face 1212*c*, although the prism face reflects substantially all the light, a small amount of light passes through, and leaks out to the exterior. The reflecting film 1213 on the diffusing reflecting face 1212*c* reflects the light that leaks out from the diffusing reflecting face 1212*c*, and returns the reflected light to the interior of the light guiding member 1212 via the diffusing reflecting face 1212*c*. Furthermore, substantially all the light escapes from a rear end face 1212*e* of the rear end portion of the light guiding member 1212. The reflecting film 1213 on one face 1212*g* of the V-shaped groove 1212*f* reflects some of the light that would escape from the rear end face 1212*e*, and returns this reflected light to the interior of the light guiding portion 1212.

The light guiding member 1212 of the optical discharge apparatus 1210 of the present example, is also capable of making the light intensity distribution of the light that illuminates the photosensitive drum 11 uniform across the entire region in the axial direction (length direction) of the photosensitive drum 11.

Furthermore, by pasting the reflecting film 1213 onto the diffusing reflecting face 1212*c* and the V-shaped groove 1212*f* in the vicinity of the rear end portion of the light guiding member 1212, the light that leaks from the diffusing reflecting face 1212*c*, and the part of the light that would have leaked from the rear end face 1212*e* are reflected and returned to the interior of the light guiding member 1212 by the reflecting film 1213, and thus the amount of light that is emitted from the light emitting face 1212*b* in the vicinity of the rear end portion of the light guiding member 1212 can be increased, and the distribution of the amount of light that is irradiated can be made even more uniform.

It should be noted that the material and the manufacturing method, for example of the light guiding member 1212 used in the optical discharge apparatus 1210 is the same as that described above in Embodiment 1.

Embodiment 3

Figure 8:
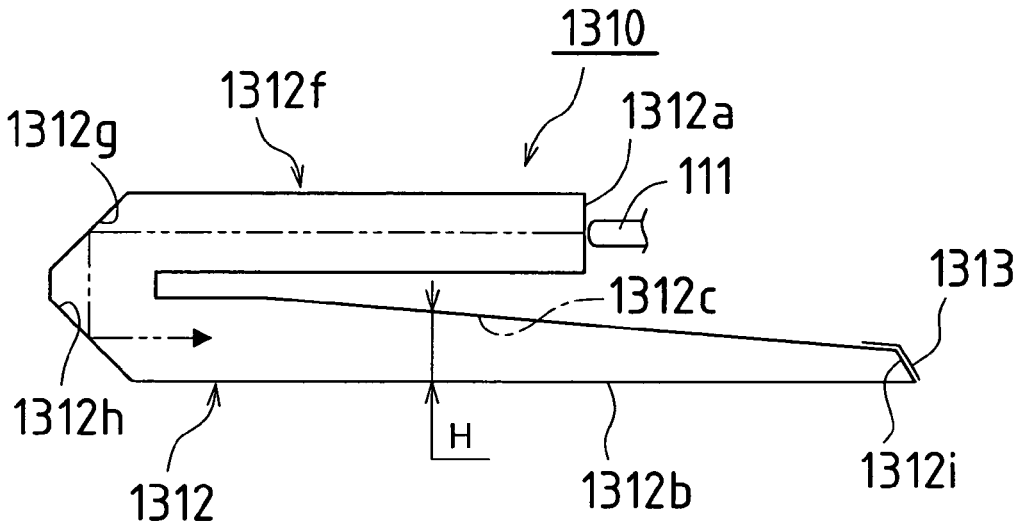
FIG. 8 is a lateral view showing an optical discharge apparatus according to Embodiment 3 of the present invention.

An optical discharge apparatus according to Embodiment 3 of the present invention is shown in FIG. 8.

An optical discharge apparatus 1310 is a modified example of the optical discharge apparatus in FIG. 4, wherein as well as providing a light guiding path portion 1312*f* that has a folded structure, reflecting faces (total reflecting faces) 1312*g* and 1312*h* for bending and guiding the light that is incident on a light incident face 1312*a* (the light emitted by the LED lamp 111) to the diffusing reflecting face 1312*c*, are formed between the light guiding path 1312*f* and the diffusing reflecting face 1312*c*. It should be noted that the height H of the diffusing reflecting face 1312*c* of a light guiding member 1312 in this example, to the light emitting face 1312*b*, and the width W of the diffusing reflecting face 1312*c*, are the same as those of the light guiding member 112 shown in FIG. 4.

Figure 9:
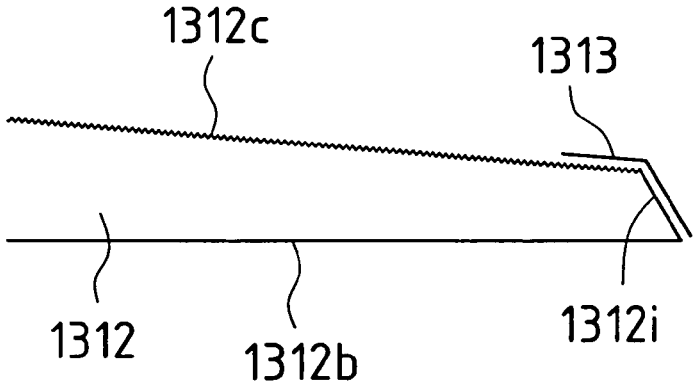
FIG. 9 is a lateral view showing an enlargement of the vicinity of a trailing edge of the light guiding member of FIG. 8.

Furthermore, as shown in the enlargement in FIG. 9, a steep inclined face 1312*i* is formed on the rear end portion of the light guiding member 1312, and a reflecting film 1313 on which aluminum vapor deposition has been performed is pasted onto the diffusing reflecting face 1312*c* and the inclined face 1312*i* in the vicinity of the rear end portion of the light guiding member 1312. The reflecting film 313 of the diffusing reflecting face 1312*c* reflects the light that leaks from the diffusing reflecting face 1312*c*, and returns this reflected light to the interior of the light guiding member 1312 via the diffusing reflecting face 1312*c*. Furthermore, the reflecting film 1313 on the inclined face 1312*i* reflects the light that would be lost from the rear end of the light guiding member 1312, and returns the reflected light to the interior of the light guiding member 1312.

With the optical discharge apparatus 1310 of the present example, it is possible to increase the length of the light path of the charge removal region without increasing the length of the light guiding member 1312 in the direction of the optical axis. As a result, it is possible to achieve a more compact image forming apparatus.

Furthermore, by pasting the reflecting film 1313 onto the diffusing reflecting face 1312*c* and the inclined face 1312*i* in the vicinity of the rear end portion of the light guiding member 1312, the light that leaks from the diffusing reflecting face 1312*c*, and the light that would have leaked from the rear end are reflected and returned to the interior of the light guiding member 1312 by the reflecting film 1313, and thus the amount of light that is emitted from the light emitting face 1312*b* in the vicinity of the rear end portion of the light guiding member 1312 can be increased, and the distribution of the amount of light that is emitted can be made even more uniform.

It should be noted that the material and the manufacturing method, for example of the light guiding member 1312 used in the optical discharge apparatus 1310 is the same as that described above in Embodiment 1.

Here, in the example in FIG. 8, the light guiding portion 1312*f* has a folded structure, however the present invention is not limited to such a structure, and the light guiding portion 1312*f* may also be provided with a structure that extends in a direction to intersect the diffusing reflecting face 1312*c* (substantially L-shaped structure).

Embodiment 4

Figure 10:
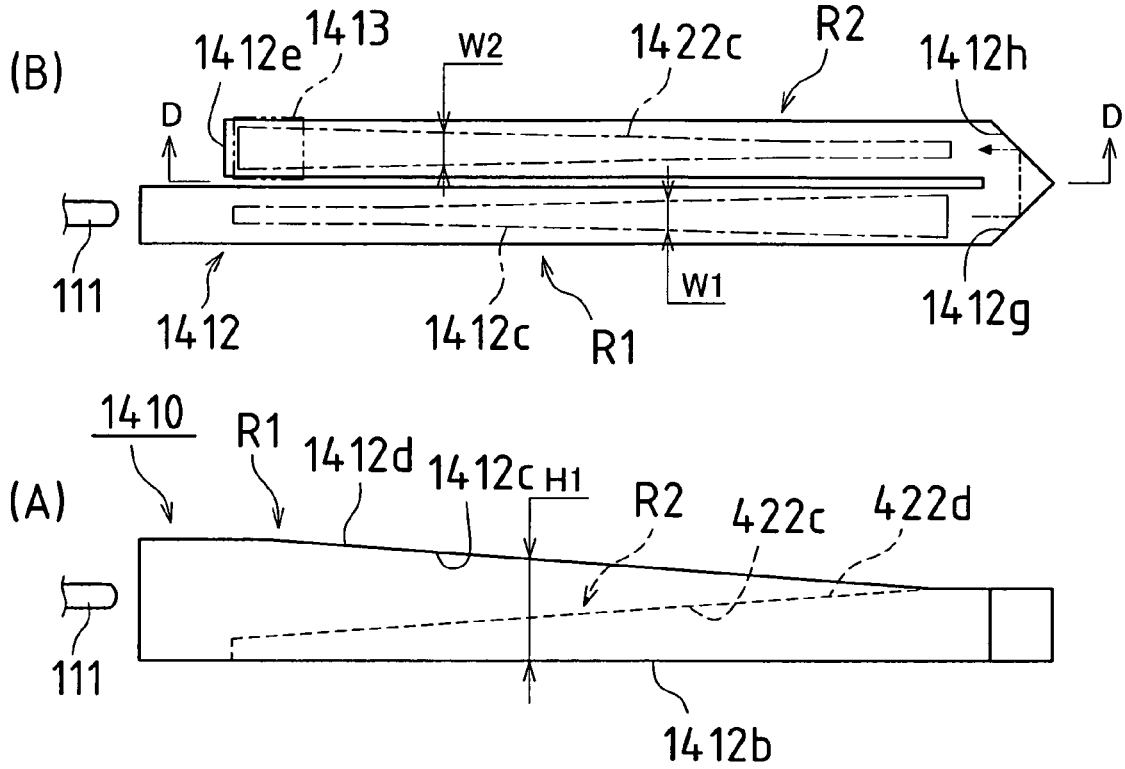
FIG. 10 is a view showing a lateral view A and a plan view B that show an optical discharge apparatus according to Embodiment 4 of the present invention.
Figure 11:
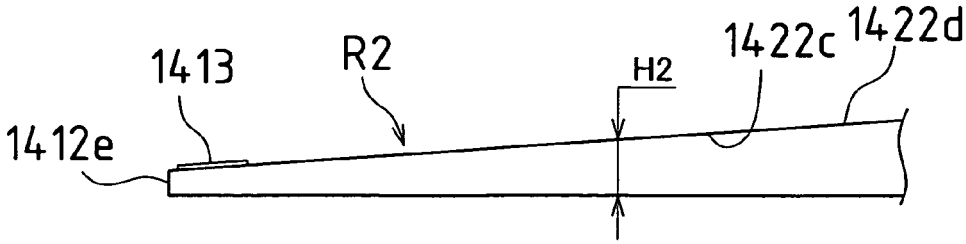
FIG. 11 is a view in the direction of the arrows D-D of FIG. 10.

The optical discharge apparatus according to Embodiment 4 of the present invention is shown in FIG. 10 and FIG. 11.

An optical discharge apparatus 1410 is provided with a first reflecting portion R1 and a second reflecting portion R2 as a light guiding member 1412 with a folded shape, wherein diffusing reflecting faces (prism faces) 1412*c* and 1422*c* that each reflect light from the LED lamp 111 toward the photosensitive drum 11 (see FIG. 3) are formed on the first reflecting portion R1 and the second reflecting portion R2, and reflecting faces (totally reflecting faces) 1412*g* and 1412*f* are formed between the two diffusing reflecting faces 1412*c* and 1422*c* to bend the light that has passed through the first reflecting portion R1 to the light path and guide it into the second reflecting portion R2.

The diffusing reflecting faces 1412*c* and 1422*c* are formed such that respective heights H1 and H2 to a light emitting face 1412*b* of the light guiding member 1412, and widths W1 and W2 of the diffusing reflecting faces 1412*c* and 1422*c* (length in a direction perpendicular to the axial direction of the photosensitive drum 11) decrease at a constant rate toward a rear end face 1412*e* of the light guiding member 1412, in accordance with the distance from the LED lamps 111. Moreover, the two diffusing reflecting faces 1412*c* and 1422*c* are formed in an arrangement such that the propagating direction of the light in each is opposite.

A reflecting film 1413 on which aluminum vapor deposition has been performed is pasted onto the diffusing reflecting face 1422*c* in the vicinity of the rear end portion of the light guiding member 1412. The reflecting film 1413 reflects the light that leaks from the diffusing reflecting face 1422*c*, and returns the reflected light to the interior of the light guiding member 1412 via the diffusing reflecting face 1422*c*.

It should be noted that in the light guiding member 1412 in FIG. 10, a rear face 1412*d* of the first reflecting portion R1 and a rear face 1422*d* of the second reflecting portion R2 are each inclined, wherein the height to the light emitting face 1412*b* at a final end portion of the first reflecting portion R1, and the height to the light emitting face 1412*b* at a front end portion of the second reflecting portion R2 are substantially equal.

With the optical discharge apparatus 1410 of the present example, since it is possible to supplement the region in which the amount of light that is reflected by one of the diffusing reflecting faces 1412*c* (or the diffusing reflecting face 1422*c*) that is formed on the light guiding member 112 is less, with the reflected light from the other diffusing reflecting face 1422*c* (or the diffusing reflecting face 1412*c*), it is possible to achieve a more uniform total light distribution in the axial direction of the photosensitive drum 11.

Furthermore, by pasting the reflecting film 1413 on the diffusing reflecting face 1422*c* in the vicinity of the rear end portion of the light guiding member 1412, the light that leaks from the diffusing reflecting face 1422*c* is reflected by the reflecting film 1413 and returned to the interior of the light guiding member 1412, and thus the amount of light that is emitted from the light emitting face 1412*b* in the vicinity of the rear end portion of the light guiding member 1412 increases, and it is possible to achieve better uniformity in the distribution of the irradiated light.

It should be noted that the material and the manufacturing method, for example of the light guiding member 1412 used in the optical discharge apparatus 1410 is the same as that described above in Embodiment 1.

Embodiment 5

Image Forming Apparatus

Figure 12:
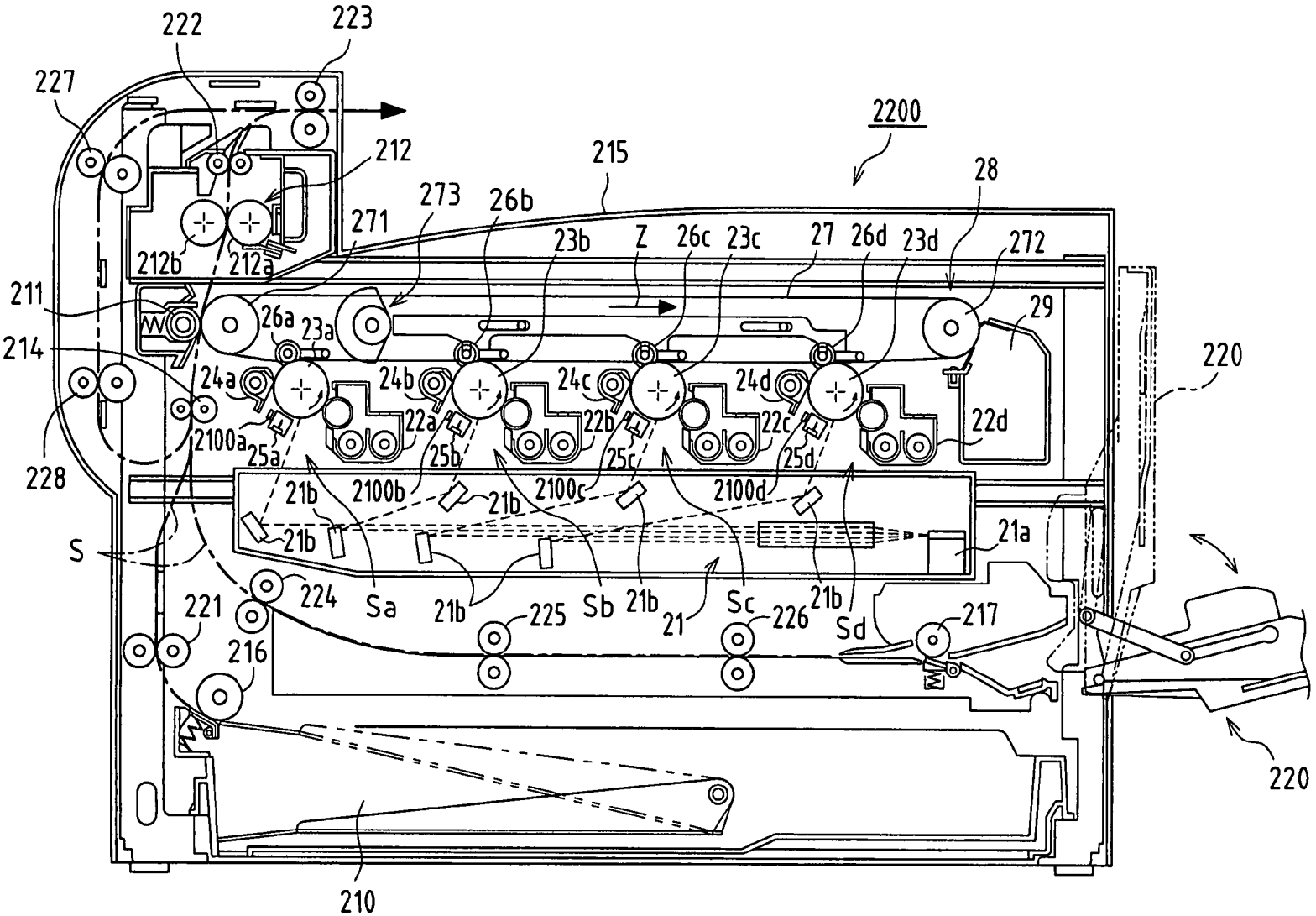
FIG. 12 is a structural overview showing an image forming apparatus according to Embodiment 5 of the present invention.

FIG. 12 is a view showing an image forming apparatus according to Embodiment 5 of the present invention.

An image forming apparatus 2200 of the present example is a color tandem image forming apparatus for forming a multicolored or monochromatic image on a predetermined piece of recording paper (sheet) in accordance with image data that is transmitted from outside, wherein it is provided with, for example, an exposure unit 21, development units 22*a* to 22*d*, photosensitive drums 23*a* to 23*d*, chargers 25*a* to 25*d*, optical discharge apparatuses 2100*a* to 2100*d*, cleaner units 24*a* to 24*d*, an intermediate transfer belt 27, an intermediate transfer belt unit 28, a fixing unit 212, a paper carry path 2S a paper supply tray 210 and a paper discharge tray 215.

The image data that is handled in the image forming apparatus 2200 is data derived from color image data that uses the colors black (K), cyan (C), magenta (M) and yellow (Y). Therefore, as shown in FIG. 12, the image forming apparatus 2200 is provided with the development units 22*a*, 22*b*, 22*c* and 22*d*, the photosensitive drums 23*a*, 23*b*, 23*c* and 23*d*, the chargers 25*a*, 25*b*, 25*c* and 25*d*, the optical discharge apparatuses 2100*a*, 2100*b*, 2100*c* and 2100*d*, and the cleaner units 24*a*, 24*b*, 24*c* and 24*d* so as to form four types of latent images in accordance with the colors (K, C, M and Y), constituting four image stations Sa, Sb, Sc and Sd corresponding to the colors (K, C, M and Y). It should be noted that the symbol "a" corresponds to black, the symbol "b" to cyan, "c" to magenta and "d" to yellow.

The photosensitive drums 23*a* to 23*d* are arranged in the upper portion of the image forming apparatus 2200.

Figure 15:
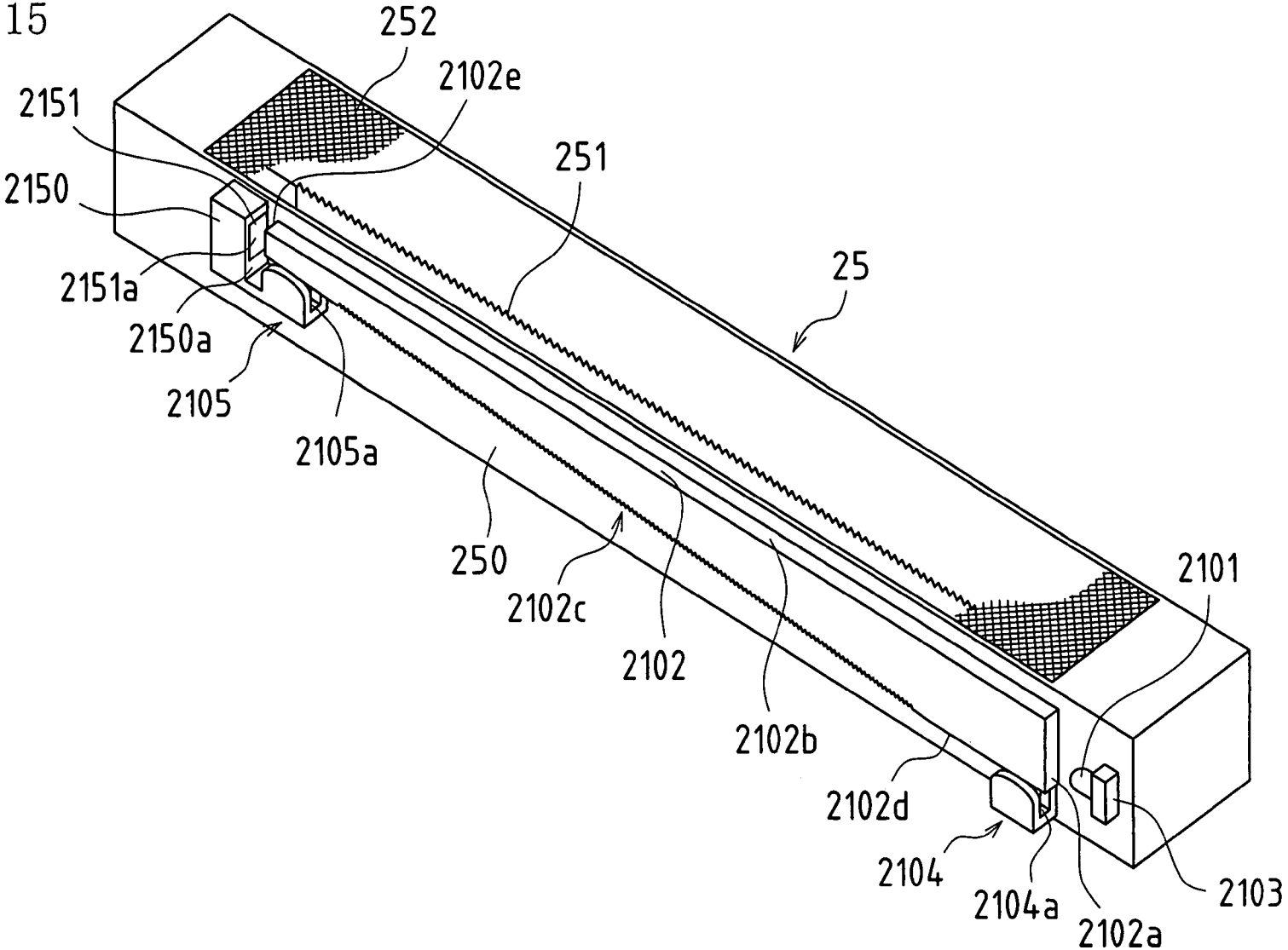
FIG. 15 is a perspective view showing how the optical discharge apparatus of FIG. 13 is attached to a corona charging unit.
Figure 17:
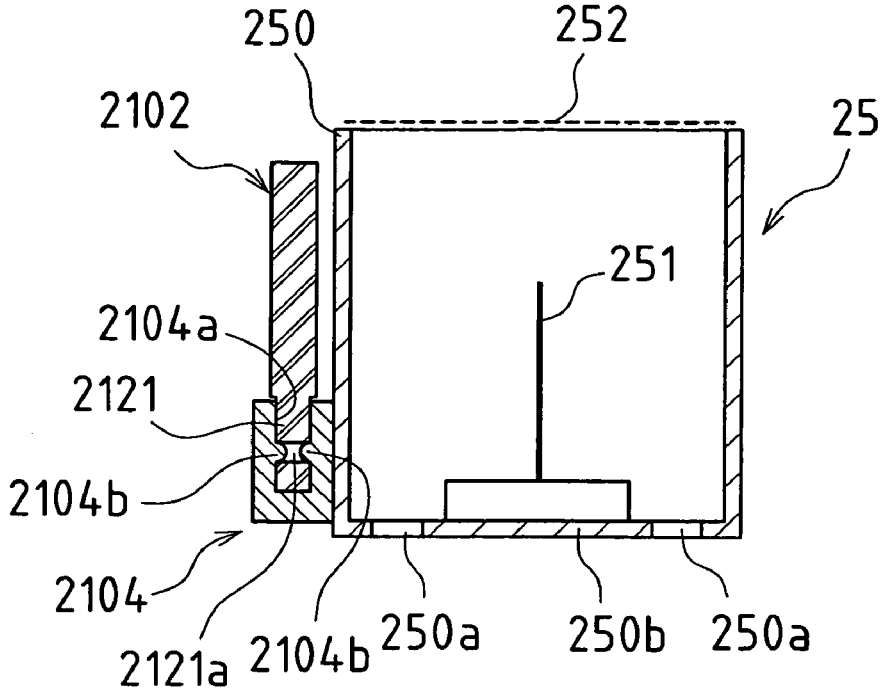
FIG. 17 is a cross-sectional view along M-M of FIG. 16.
Figure 18:
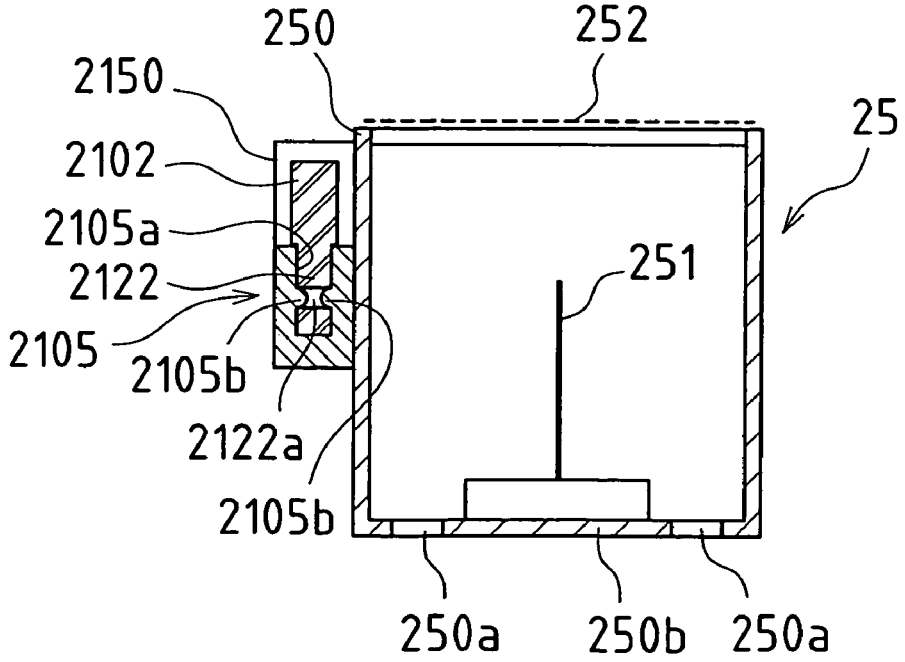
FIG. 18 is a cross-sectional view along N-N of FIG. 16.

The chargers 25*a* to 25*d* are charging means for charging the surface of the photosensitive drums 23*a* to 23*d* with a predetermined, uniform electric potential, and in this example, corona charging units are used that have a sawtooth-shaped discharge electrode 251, a net-shaped grid 252 and a charger case 250 that covers the discharge electrode 251, as shown in FIG. 15, FIG. 17 and FIG. 18. The optical discharge apparatuses 2100*a* to 2100*d* are devices for removing the electric charge from the surface of the photosensitive drums 23*a* to 23*d*. It should be noted that the details of the optical discharge apparatuses 2100*a* to 2100*d* are described hereinafter.

The exposure unit 21 exposes the charged photosensitive drums 23*a* to 23*d* in accordance with the input image data, and functions so as to form an electrostatic latent image on the surface of the photosensitive drums 23*a* to 23*d* in accordance with the image data. The exposure unit 21 uses a laser scanning unit (LSU) that is provided with a laser irradiating portion 21*a* and a reflecting mirror 21*b*, for example. It should be noted that it is also possible to use light emitting elements that are arranged in an array, such as ELs or an LED writing head, for example, as the exposure unit 21.

The development units 22*a* to 22*d* develop the electrostatic latent image formed on each of the photosensitive drums 23*a* to 23*d* with colored (K, C, M and Y) toner. The cleaner units 24*a* to 24*d* remove and collect the residual toner left on the surface of the photosensitive drums 23*a* to 23*d* after development and image transfer.

The intermediate transfer belt unit 28 is arranged above the photosensitive drums 23*a* to 23*d*. The intermediate transfer belt unit 28 is provided with the intermediate transfer belt 27, an intermediate transfer belt drive roller 271, an intermediate transfer belt tensioning mechanism 273, an intermediate transfer belt driven roller 272, intermediate transfer rollers 26*a*, 26*b*, 26*c* and 26*d*, and an intermediate transfer belt cleaning unit 29. The intermediate transfer belt 27 stretches around the intermediate transfer belt drive roller 271, the intermediate transfer belt tension mechanism 273, the intermediate transfer rollers 26*a* to 26*d* and the intermediate transfer belt driven roller 272, for example, and these rotatably drive the intermediate drive belt 27 in the direction of an arrow Z.

The intermediate transfer rollers 26*a* to 26*d* are supported such that they is capable of rotation, by an intermediate transfer roller attachment portion (not shown) in the intermediate transfer belt tension mechanism 273 of the transfer belt unit 28, and these give a transfer bias so as to transfer the toner image on the photosensitive drums 23*a* to 23*d* onto the intermediate transfer belt 27.

The intermediate transfer belt 27 is arranged so as to contact each of the photosensitive drums 23*a* to 23*d*, and forms a color toner image (multi color toner image) on the intermediate transfer belt 27 by sequentially layering and transferring the colored toner images formed on the photosensitive drums 23*a* to 23*d* onto the intermediate transfer belt 27. The intermediate transfer belt 27 is formed as an endless loop using film having a thickness of approximately 100 to 150 μm. It should be noted that during monochromatic printing, only the black (K) photosensitive drum 23*a* touches the intermediate belt 27.

Transfer of the toner images from the photosensitive drums 23*a* to 23*d* on to the intermediate transfer belt 27 is performed by the intermediate transfer rollers 26*a* to 26*d* that are in contact with the back side of the intermediate transfer belt 27. The intermediate transfer rollers 26*a* to 26*d* are applied with a high voltage transfer bias (a high voltage that is the opposite polarity (+) to the polarity of the charge on the toner (−)) for the purpose of transferring the toner images.

The intermediate transfer rollers 26*a* to 26*d* have a metal (for example, stainless steel) axle with a diameter of 8 to 10 mm as a base, and the surface of this is covered by an electrically conductive elastic material (such as EPDM or polyurethane foam). The electrically conductive elastic material enables the uniform application of a high voltage on the intermediate transfer belt 27. It should be noted that in this example, the intermediate transfer rollers 26*a* to 26*d* are used as transfer electrodes, but alternatively, brushes or the like may also be used.

As described above, the electrostatic images that are developed in accordance with the colored layers on the photosensitive drums 23*a* to 23*d* are layered onto the intermediate transfer belt 27 and this is image information that is input to the apparatus. By the rotation of the intermediate transfer belt 27, the image information that is layered in this way is transferred onto the recording paper by a transfer roller 211 that is arranged in the position at which the recording paper (described hereinafter) contacts the intermediate transfer belt 27.

At this time, the intermediate transfer belt 27 and the transfer roller 211 are pressed together in a predetermined nip, and a voltage (a high voltage having a polarity (+) that is opposite to the polarity of the charge on the toner (−)) is applied to the transfer roller 211 to allow it to transfer the toner to the recording paper. Moreover, in order for the transfer roller to regularly obtain the above-noted nip, it is preferable that either one of the transfer roller 211 or the intermediate transfer belt drive roller 271 is made of a hard material (such as a metal) and the other is made of a soft material, such as an elastic roller (for example, an elastic rubber roller or a foam resin roller).

As described above, the toner that is fixed to the intermediate transfer belt 27 by contact with the photosensitive drums 23*a* to 23*d*, or the toner that remains on the intermediate transfer belt 27 without transferring onto the recording paper by the transfer roller 211 is a cause of toner color mixing in the following process, and thus the intermediate transfer belt 27 is constituted such that the toner can be removed and collected by the intermediate transfer belt cleaning unit 29.

The intermediate transfer belt cleaning unit 29 is provided with a member that is in contact with the intermediate transfer belt 27, for example a cleaning blade, as the cleaning member, and the intermediate transfer belt 27 that contacts the cleaning blade is supported from behind by the intermediate transfer belt driven roller 272.

The paper feed tray 210 is a tray for stacking recording paper (recording sheets) for use when forming images, and is provided below the exposure unit 21 of the image forming apparatus 2200. Furthermore, the paper discharge tray 215 provided in the upper portion of the image forming apparatus 2200 is a tray for holding the recording paper that has been printed, face down.

The image forming apparatus 2200 is provided with a substantially perpendicular-shaped paper carry path S for sending the recording paper in the paper feed tray 210 to the paper discharge tray 215 via the transfer portion 211 or the fixing unit 212. Moreover, a pickup roller 216, a register roller 214, the transfer roller 211, the fixing unit 212 and carry rollers 221 to 228 for transporting the recording paper are disposed in the vicinity of the paper carry path S from the paper feed tray 210 to the paper discharge tray 215.

The transport rollers 221 to 226 are small rollers used for facilitating and assisting the recording paper, and a plurality of these is arranged along the paper carry path S.

The pickup roller 216 is provided at an end portion of the paper feed tray 210. The pickup roller 216 is a lead-in roller that delivers recording paper one page at a time into the paper carry path S. The register roller 214 is a roller that temporarily supports the recording paper that is being transported in the paper carry path S, and transports the recording paper to the transfer roller 211 at a timing that matches the tip of the toner image on the intermediate transfer belt 27 to the tip of the recording paper.

The fixing unit 212 is provided with a heat roller 212*a* and a pressure roller 212*b*, for example. The heat roller 212*a* and the pressure roller 212*b* are arranged to rotatably sandwich the recording paper.

Furthermore, the heat roller 212*a* is set so as to maintain a predetermined constant temperature by control based on signals from a temperature detecting device, not shown. The heat roller 212*a* heats and presses the recording paper against the pressure roller 212*b* to melt, mix and pressure the multicolored toner image that is transferred to the recording paper, and to thermally fix the image to the recording paper.

It should be noted that after fixing the multicolored toner image, the recording paper is transported along the reverse discharge path of the paper carry path S by the transport rollers 222 and 223, and is discharged to the paper discharge tray 215 in an overturned state (where the multicolored toner image is facing down).

Next, the paper carry path will be described in detail.

First, the image forming apparatus of the present example is arranged with a paper feed cassette 210 that is pre-loaded with recording paper, and a manual feed tray 220 for when a user prints a few pages without the need to open and close the paper feed cassette 210. Paper feeding using the paper feed cassette 210 and the manual feed tray 220 is performed by a method in which the recording paper is fed into the carry path one page at a time by the pickup rollers 216 and 217 arranged at the end portions of each tray 210 and 220.

The recording paper that is transported from the paper feed cassette 210 is transported through the carry path to the register roller 214 by the transport roller 221, and is then transported to the transfer roller 211 with a timing in which the tip of the recording paper coincides with the tip of the image information on the intermediate transfer belt 27, wherein the image information is written onto the recording paper. After this, the recording paper is discharged from the discharge roller 223 onto the discharge tray 215 after passing through the fixing unit 212 where the unfixed toner is melted and fixed onto the recording paper, and then from the paper discharge roller 223 to the paper discharge tray 215 via the transport roller 222 (when printing is requested on one side).

On the other hand, recording paper that is loaded into the manual paper feed tray 220 is fed in by the pickup roller 217, wherein it arrives at the register roller 214 via the plurality of transport rollers 226, 225 and 224, and after this is discharged to the paper discharge tray 215 via the same process taken by the recording paper fed from the paper feed cassette 210 (when printing is requested on one side).

Here, when the content of the print request is for two-sided printing, when the single sided printing as described above is complete, the rear tip of the recording paper that has passed through the fixing unit 212 is clamped by the paper discharge roller 223, and is guided into the transport rollers 227 and 228 by the reverse rotation of the paper discharge roller 223. Printing is performed on the back side of the recording paper via the resist roller 214, after which it is discharged to the paper discharge tray 215.

Optical Discharge Apparatus

Next, the optical discharging devices 2100*a* to 2100*d* (hereinafter referred to as "the optical discharge apparatus 2100") are described. It should be noted that in the following description, the photosensitive drums 23*a* to 23*d* are referred to as "the photosensitive drum 23".

As shown in FIG. 13 to FIG. 18, the optical discharge apparatus 2100 is provided with an LED lamp 2101, which is a point light source, and a light guiding member (made of a transparent material) 2102.

Figure 16:
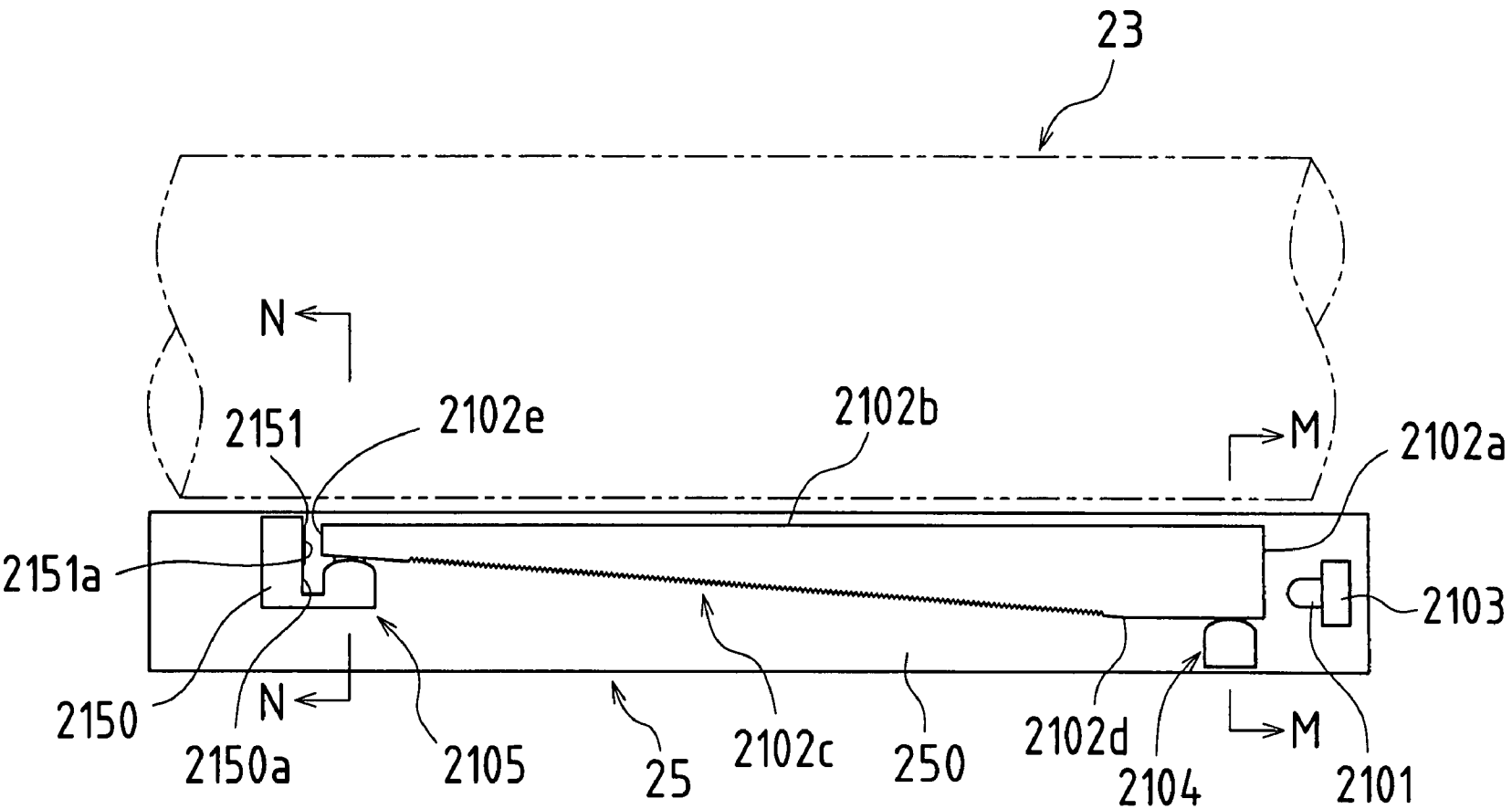
FIG. 16 is a perspective view showing how the optical discharge apparatus of FIG. 13 is attached to a corona charging unit.

As shown in FIG. 16, the light guiding member 2102 is a belt-shaped member that extends in a direction that is parallel to the photosensitive drum 23, and a face that opposes the photosensitive drum 23 is a light emitting face 2102*b*. An end face (a tip face) in the length direction of the light guiding member 2102 is a light incident face 2102*a*, and the LED lamp 2101 faces opposite the light incident face 2102*a*.

Figure 13:
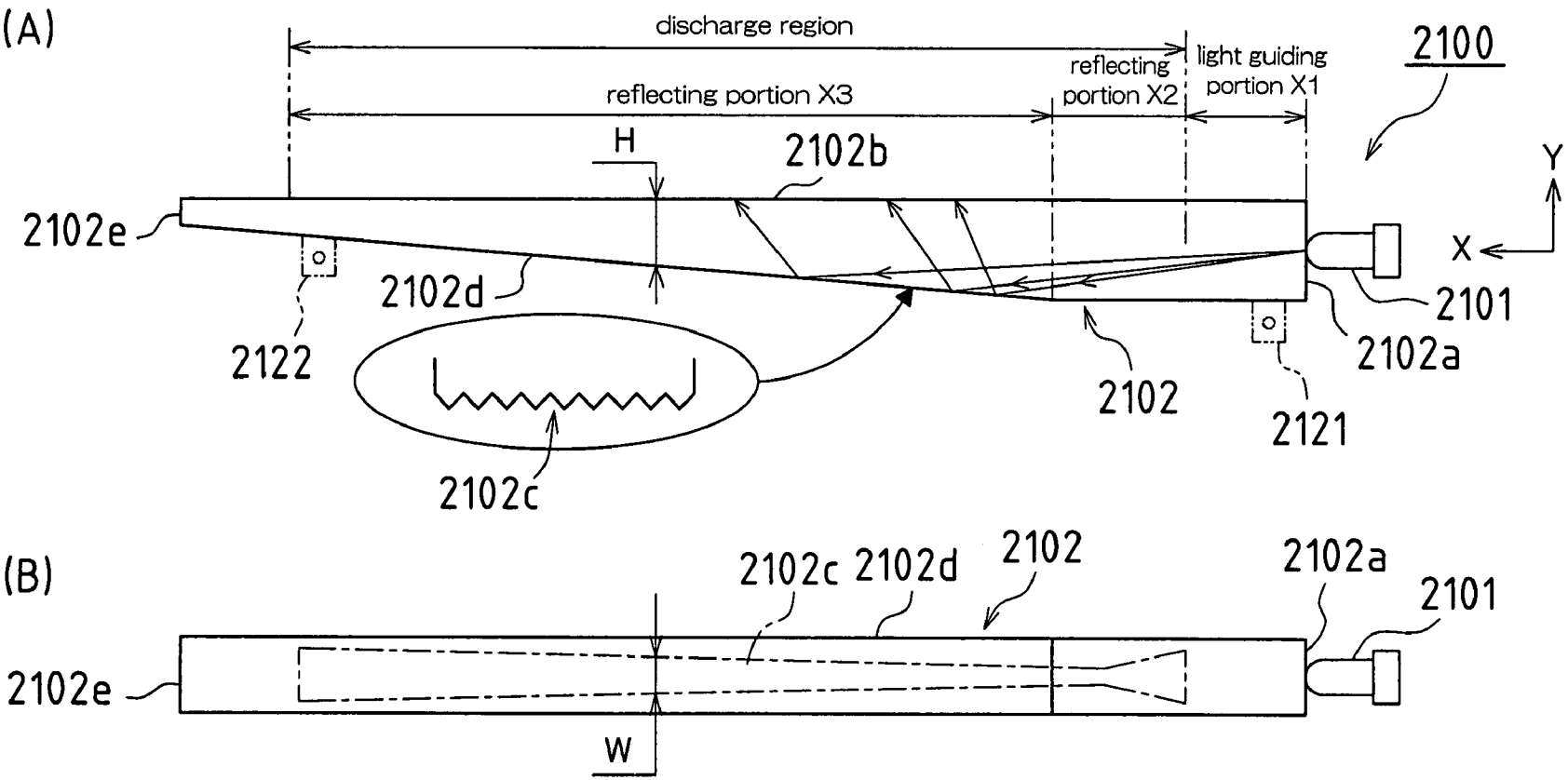
FIG. 13 is a view schematically showing a lateral view A and a bottom view B of the optical discharge apparatus according to Embodiment 5 of the present invention.

The light guiding member 2102 is formed with a light guiding path portion X1 that is a light guiding path for light from the LED lamp 2101 and a reflecting portion X2 and a reflecting portion X3 as shown in FIG. 13 that constitute a charge removal region. The reflecting portion X2 is processed into a shape such that the light emitting face 2102*b* and its back face 2102*d* are parallel. The reflecting portion X3 is processed into a shape in which the back face 2102*d* is inclined with respect to the light emitting face 2102*b*, and the back face 2102*d* is shaped such that it approaches the light emitting face 2102*b* in the direction of a rear end face 2102*e* of the light guiding member 2102. It should be noted that the rear end face 2102*e* of the light guiding member 2102 is an optically transparent surface that is capable of allowing light to pass due to end portion processing.

The region corresponding to the reflecting portion X2 and the reflecting portion X3, on the back face 2102*d* of the light guiding member 2102 is formed as a diffusing reflecting face (prism face) 2102*c* for reflecting the light from the LED lamp 111 toward the photosensitive drum 11. In the light reflecting portion X2, a height H of the diffusing reflecting face 2102*c* is constant with respect to the light emitting face 2102*b*. In the reflecting portion X3, the height H of the diffusing reflecting face 2102*c* to the light emitting portion X2 decreases toward the end face portion of the reflecting portion X3 (rear end face portion 2102*e* of the light guiding member 2102). Moreover, a width W of the diffusing reflecting face 2102*c* (length in a direction that is perpendicular to the axial direction of the photosensitive drum 23) is not constant, but as shown in FIG. 13B, is formed in a pattern in which the width reduces from the end portion of the light receiving side of the reflecting portion X2 toward the reflecting portion X3, and then the width widens from within the reflecting portion X2 extending toward the rear end portion of the reflecting portion X3 (the rear end face 2102*e* of the light guiding member 2102).

As described above, for the light guiding member 2102 of the present example, the height H (length in the Y direction) of the diffusing reflecting face 2102*c* that reflects the light from the LED lamp 2101 toward the photosensitive drum 23, to the light emitting face 2102*b*, changes with respect to the distance to the LED lamp 2101 (position in the X direction), and the width W of the diffusing reflecting face 2102*c* also changes with respect to the distance to the LED lamp 2101 (position in the X direction), and thus it is possible to provide a uniform light intensity distribution of irradiated light onto the photosensitive drum 23, across the entire region in the axial direction (length direction) of the photosensitive drum 23. Consequently, it is possible to obtain high quality images that do not have image inconsistencies or the like.

Here, excluding indentations of the prism face, for example, that are formed on the diffusing reflecting face 2102*c*, all the faces of the light guiding member 2102 used as the optical discharge apparatus 2100 of the present example are smooth. The light guiding member 2102 is fabricated by molding a transparent material such as acrylic resin, polycarbonate resin, polystyrene resin, polyvinyl chloride resin or glass by injection molding or extrusion molding, and then grinding, for example, where necessary. Or, the light guiding member 2102 may also be fabricated by making all its surfaces smooth, and attaching a piece of cloudy white diffusing tape only over the part that is to be the diffusing reflecting face 2102*c*.

The LED lamp 2101 used in the optical discharge apparatus 2100 of the present example may be fabricated by, for example, bonding an LED chip onto a metal lead and sealing that part into a lens shape made of a transparent resin, and then arranging this in the vicinity of the light incident face 2102*a* of the light guiding member 2102. For the LED lamp 2101, it is possible to suggest a super high intensity LED lamp, with, for example, a wavelength of 618 nm and a test resistance of 200 Ω (manufactured by Sharp, product code: GL5ZJ43).

Structure for Attaching the Light guiding Member and the like

Structures for attaching the light guiding member 2102 and the like will be described next.

As shown in FIG. 15 to FIG. 18, the light guiding member 2102 is supported via a front supporting member 2104 on a side face of the charger case 250 of the chargers 25*a* to 25*d* (hereinafter referred to as "the corona charging unit 25"), and a rear supporting member 2105. The front supporting member 2104 and the rear supporting member 2105 are each fixed to a side face of the charger case 250.

Figure 14:
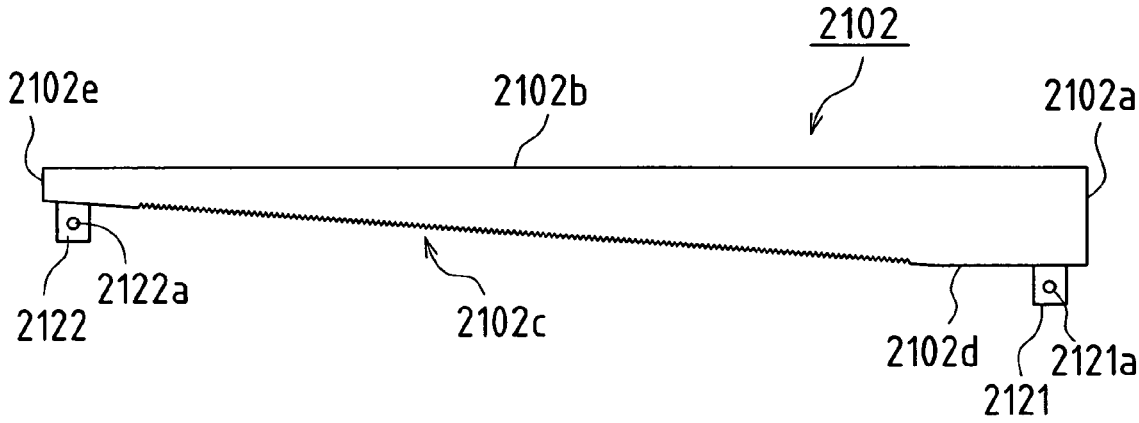
FIG. 14 is a lateral view of the light guiding member used in the optical discharge apparatus of FIG. 13.

A front supporting piece 2121 and a rear supporting piece 2122 are each formed as a single piece below the front end portion and below the rear end portion of the light guiding member 2102, as shown in FIG. 14. Through holes 2121*a* and 2122*a* for positioning and fixing are provided in a center portion of the front supporting piece 2121 and the rear supporting piece 2122 respectively.

On the other hand, the front supporting member 2104 and the rear supporting member 2105 are both made of molded resin. The front supporting member 2104 is provided with a concave fitting portion 2104*a* into which the front supporting piece 2121 of the light guiding member 2102 is capable of fitting, as shown in FIG. 17, and stopper protrusions 2104*b* are provided in the center of interior faces of the concave fitting portion 2104*a*. Furthermore, as shown in FIG. 18, the rear supporting member 2105 is also provided with a concave fitting portion 2105*a* into which the rear supporting piece 2122 of the light guiding member 2102 is capable of fitting, and stopper protrusions 2105*b* are provided in the center of interior faces of the concave fitting portion 2105*a*.

By fitting the front supporting piece 2121 and the rear supporting piece 2122 of the light guiding member 2102 into the concave fitting portion 2104*a* of the front supporting member 2104, and the concave fitting portion 2105*a* of the rear supporting member 2105 respectively, and fitting the stopper protrusions 2104*b* into the through hole 2121*a* of the front supporting piece 2121, and fitting the stopper protrusions 2105*b* into the through hole 2122*a* of the rear supporting piece 2122, it is possible to support the front end portion and the rear end portion of the light guiding member 2102 with the front supporting member 2104 and the rear supporting member 2105 respectively, and to position and fix the entirety of the light guiding member 2102 to the side face of the charger case 250.

It should be noted that when the light guiding member 2102 is fixed to the charger case 250 in this manner, the shape and dimensions of the parts such as the front supporting member 2104 and the rear supporting member 2105 are set such that the light emitting face 2102*b* of the light guiding member 2102 is positioned below the top face of the charger case 250. Furthermore, the LED lamp 2101 is arranged in a position such that it faces the light incident face 2102*a* of the light guiding member 2102 when fixed to the charger case 250. The LED lamp 2101 is supported via a supporting member 2103 on a side face of a rear side frame plate (not shown) of the image forming apparatus.

In this way, by creating a structure to support the light guiding member 2102 with the charger case 250 of the corona charging unit 25, it is possible to reduce the installed space of the light guiding member 2102. In particular, if the image forming apparatus is a color tandem-type image forming apparatus 2200, then conventionally, the installed space of the light guiding member 2102 (the occupied space) has been an impediment to achieving miniaturization, however in this example, it is possible to reduce the installed space of the light guiding member 2102 for each of the image stations Sa, Sb, Sc and Sd corresponding to the colors, and thus to achieve a great reduction in the size of the entire apparatus.

The present example is characterized in that, as described above, the rear end face 2102*e* of the light guiding member 2102 is an optically transparent face, and in that a reflecting face 2151 is arranged behind the rear end face 2102*e* of the light guiding member 2102. This configuration will be described in further detail below.

First, in the present example, as shown in FIG. 15 and FIG. 16, a reflecting member 2150 is formed as a single piece with the rear supporting member 2105 that supports the rear end portion of the light guiding member 2102. The reflecting member 2150 is a four-cornered columnar member that extends from a lower position to an upper position of the rear end face 2102*e* of the light guiding member, in the vertical direction, and is positioned behind the rear end face 2102*e* of the light guiding member 2102. A reflecting film 2151 is pasted on an opposing face 2150*a* of the reflecting member 2150 that opposes the rear end face 2102*e* of the light guiding member 2102, and the front face of the reflecting film 2151 is the reflecting face 2151*a*. The reflecting face 2151*a* of the reflecting member 2150 is a face that is parallel to a flat face that is perpendicular to the axial direction of the photosensitive drum 23, and the reflecting face 2151*a* is arranged in a position in which a predetermined gap (for example 0.5 mm) exists between it and the rear end face 2102*e* of the light guiding member 2102. It should be noted that a thin metal film of aluminum, chromium, nickel, chrome-nickel alloy or gold, for example, that is formed is a thin metal film on the surface of a polycarbonate film by vapor deposition or the like is used as the reflecting film 2151.

As described above, by setting the rear end face 2102*e* of the light guiding member 2102 to be an optically transparent face, and arranging the reflecting face 2151*a* behind the rear end face 2102*e* of the light guiding member 2102 in a separated state, the amount of light that is irradiated onto the photosensitive drum 23 from the vicinity of the rear end portion of the light guiding member 2102 can be increased in addition to the effect of making the emitted light more uniform due to the shape (design of the height and width) of the diffusing reflecting face 2102*c* described above, and thus the distribution of irradiated light that is irradiated onto the photosensitive drum 23 can be made even more uniform.

Moreover, since the reflecting member 2150 is formed as a single piece with the rear supporting member 2105 that supports the rear end portion of the light guiding member 2102, the positional relationship between the rear end face 2102*e* of the light guiding member 2102, and the reflecting face 2151*a* can be maintained as a constant, and thus it is possible to ensure a consistent, stable reflectance.

It should be noted that in the aforementioned example, the reflecting face 2151*a* has been arranged with a gap to the rear end face 2102*e* of the light guiding member 2102, however the reflecting face 2151*a* may also be arranged such that it is in contact with the rear end face 2102*e* of the light guiding member 2102 (gap=0 mm).

Furthermore, the reflecting face 2151*a* is formed by pasting the reflecting film 2151 onto the opposing face 2150*a* of the reflecting member 2150, however, it is also possible form the reflecting face 2151*a* by forming a thin metal film such as chromium, nickel, chrome-nickel alloy or gold directly onto the opposing face 2150*a* of the reflecting member 2150. Moreover, if the rear supporting member 2105 (reflecting member 2150) is constituted by metal, then it is also possible to mirror polish the opposing face 2150*a* that faces the rear end face 2102*e* of the light guiding member 2102 to form a reflecting face 151*a*.

The optical discharge apparatus of the present invention also includes supporting members such as the front supporting member 2104 and the rear supporting member 2105 described above (including the reflecting member 2150) as constituent elements.

Other Characteristic Parts

As shown in FIG. 17 and FIG. 18, the charger case 250 of the corona charging unit 25 used in the present example has opening portions 250*a* for allowing air to discharge out through a case base plate 250*b*. The opening portions 250*a* are slit-shaped apertures that extend in the length direction of the charger case 250. By providing the opening portions 250*a* for air discharge in the case base plate 250*b* of the charger case 250 in this way, and arranging the light guiding member 2102 in a higher position that the opening portions 250*a*, the deleterious effects of air that includes ozone generated in the charger case 250 on the light guiding member 2102 can be prevented. That is to say, the ozone that is generated by the corona discharge will accumulate in the base portion of the charger case 250 under its own weight. However since the accumulated ozone is discharged downward through the opening portions 250*a*, by arranging the light guiding member 2102 in a position that is higher than the opening portions 250*a*, it is possible to prevent the diffusing reflecting face 2102*c* of the light guiding member 2102 and the reflecting face 2151*a* of the reflecting member 2150, for example, from degrading (corroding and the like) due to the ozone.

Figure 19:
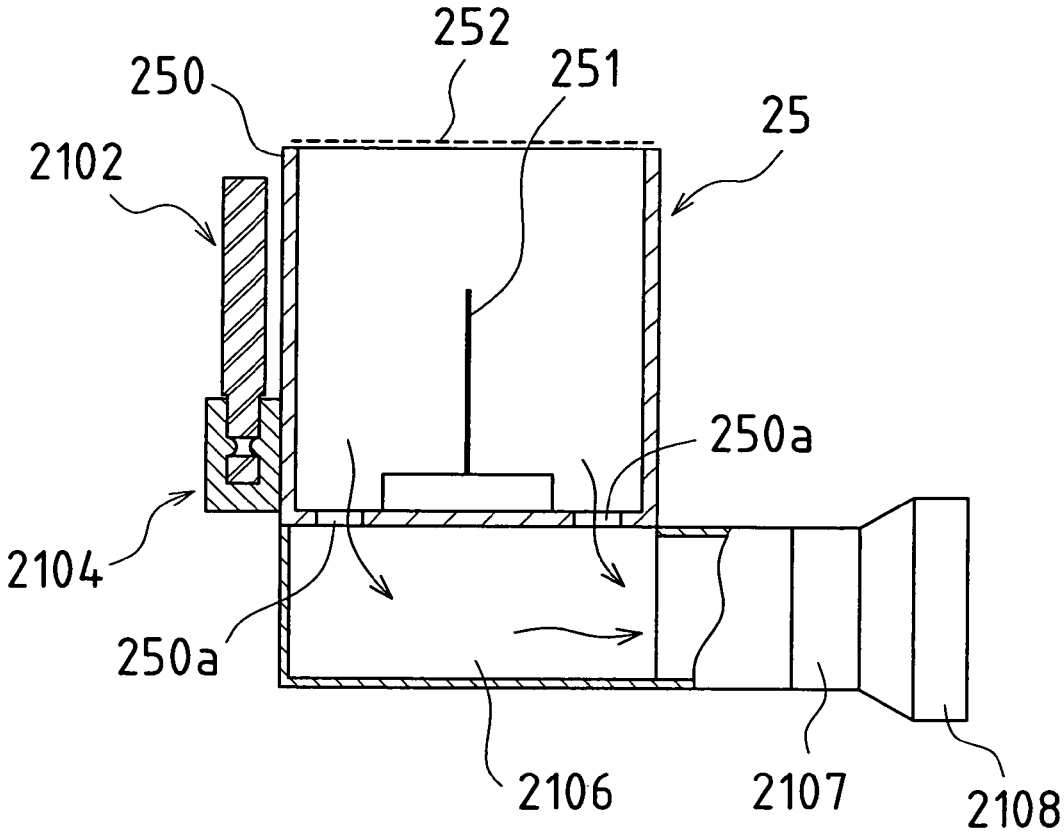
FIG. 19 is a view that schematically shows the configuration of the forcible exhaust mechanism of the corona charging unit.

Also, by providing an exhaust duct 2106, an exhaust fan 2107 and an ozone removal filter 2108 for extracting air that contains ozone from the lower portion of the charger case 250, and then driving the exhaust fan 2107, as shown in FIG. 19, and configuring the charger case 250 so as to guide the air that contains the ozone generated in the charger case 250 to the exhaust duct 2106 via the apertures 250*a* at the bottom portion of the charger case 250, to forcibly discharge that air, it is possible to effectively prevent degradation of the light guiding member 2102 and the reflecting member 2150. Moreover, when forcibly ejecting air in this way, it is also possible to configure the four exhaust ducts, each of which is individually arranged on the corona charging unit 25 (25*a* to 25*d*) of the image station Sa to Sd corresponding to each color to be connected into a collection duct, wherein the air that is collected in that collection duct exhausted by the exhaust fan via the ozone removal filter. When this configuration is employed, it is further possible to reduce the size of the entire apparatus, and is thus preferable.

In the examples described above, the width of the diffusing reflecting face 2102*c* of the light guiding member 2102 is altered, but the present invention is not limited to this example. The present invention may also be applied to optical discharge apparatuses and image forming apparatuses that use a light guiding member in which the width of the diffusing reflecting face is constant, and only the height (height of the light guiding member) is altered.

In the examples above, an example has been shown in which the present invention is applied to a color tandem-type image forming apparatus, however, the present invention may also be applied to an image forming apparatus that forms monochromatic images.

The examples of the optical discharge apparatuses according to Embodiments 1 to 5 of the present invention are described below together with comparative examples.

WORKING EXAMPLES AND COMPARATIVE EXAMPLES

Figure 20:
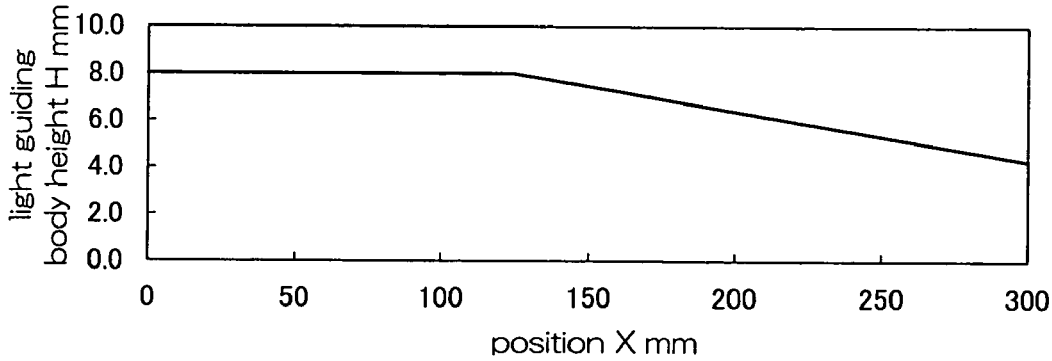
FIG. 20 is an explanatory diagram of an embodiment of the present invention.
Figure 20:
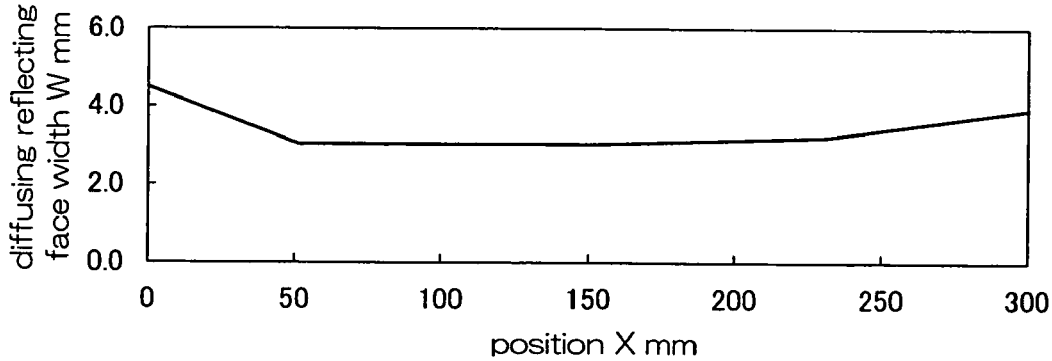

First, in the optical discharge apparatus 110 according to Embodiment 1 to 4 shown in FIG. 3 and FIG. 4, the thickness of the light guiding member 112 was set to 3 mm and the length of the diffusing reflecting face 112*c* to 300 mm, the height (height of the light guiding member) H of the light diffusing face 112*c* to the light emitting face 112*b* was set to a constant (H=8 mm) from the front end portion (X=0) of the diffusing reflecting face 112*c* to X=125 mm, as shown in FIG. 20A and was changed (decreased) at a constant rate in a range of 8 mm to 4.2 mm, over a region from the position of X=125 to the rear end portion of the diffusing reflecting face 112*c* (X=300 mm). Moreover, as shown in FIG. 20B, the width W of the diffusing reflecting face 112*c* was changed (reduced) at a constant rate in a range of 4.5 mm to 3 mm over the region from the front end portion of the diffusing reflecting face 112*c* (X=0) to X=50, and was changed (increased) in a pattern as shown in the drawing in the range of 3 mm to 4 mm, from the position of X=50 to the rear end portion of the diffusing reflecting face 112*c* (X=300 mm).

Figure 21:
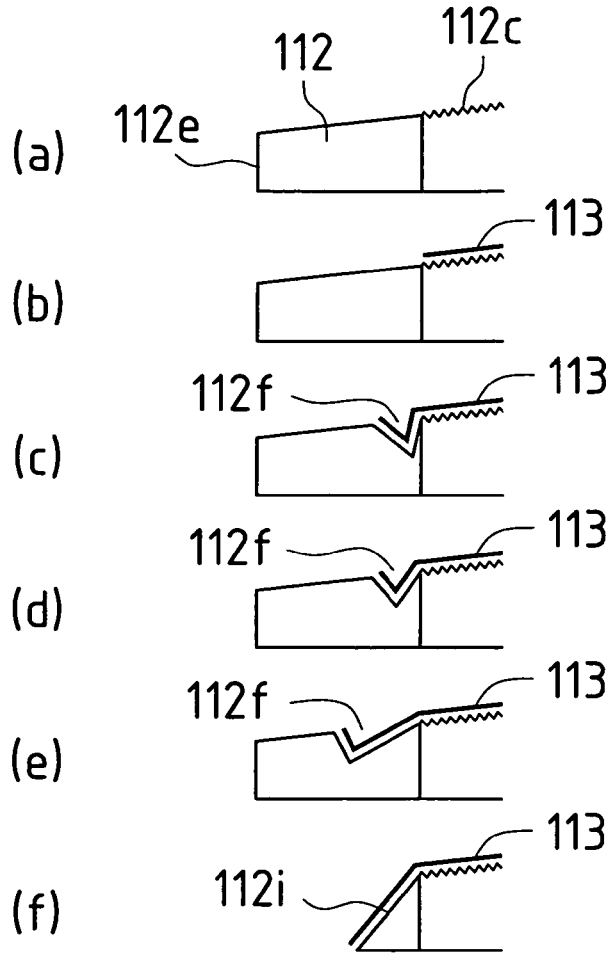
FIG. 21 is a lateral view showing an overview of the vicinity of a rear end portion of each light guiding member of Comparative Example 1 and Working Examples 1 to 5.

Then, a light guiding member 112 in which the vicinity of the rear end portion thereof has not been processed in any way, as shown in FIG. 21A, was taken to be Comparative Example 1, a light guiding member 112 in which the reflective film 113 has been pasted onto an upper face the vicinity of the rear end portion, as shown in FIG. 21B was taken to be Working Example 1, light guiding bodies 112 into which a V-type groove has been formed on the upper face in the vicinity of the rear end portion, and onto which a reflecting film 113 is pasted, as shown in FIG. 21C, FIG. 21D and FIG. 21E were set as Working Examples 2, 3 and 4, and a light guiding member 112 on whose rear end portion an inclined face 112*i* is formed, and onto which the reflecting film 113 is pasted, as shown in FIG. 21F was taken to be Working Example 5.

Figure 22:
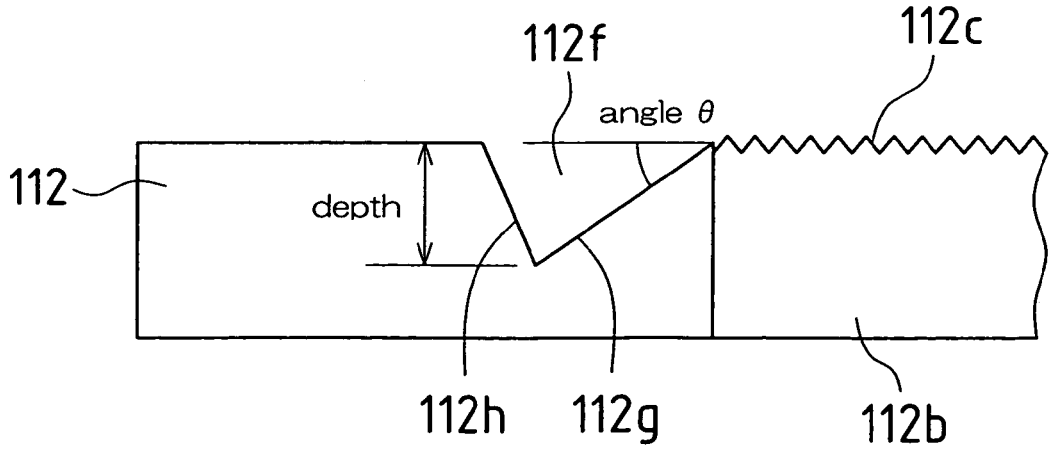
FIG. 22 is an explanatory diagram of the angles of the faces of the rear end portion of the light guiding member.

An angle of inclination θ of one face 112*g* of the V-shaped groove 112*f* in the Working Examples 2 to 4, is an angle of inclination downwards with respect to the upper face of the light guiding member 112, as shown in FIG. 22. In Working Example 2, the angle of inclination θ was set to 75°, in Working Example 3, the angle of inclination θ was set to 45°, and in Working Example 4, the angle of inclination θ was set to 15°. In each one of Working Examples 2 to 4, the depth of the V-shaped groove 112*f* was set to 1 mm. Furthermore, in Working Example 5, the angle of inclination θ was set to 45°.

The table of FIG. 23 shows the specifications in the vicinity of the rear end portion of the light guiding member 112, separately for Comparative Example 1 and Working Examples 1 to 5.

Figure 24:
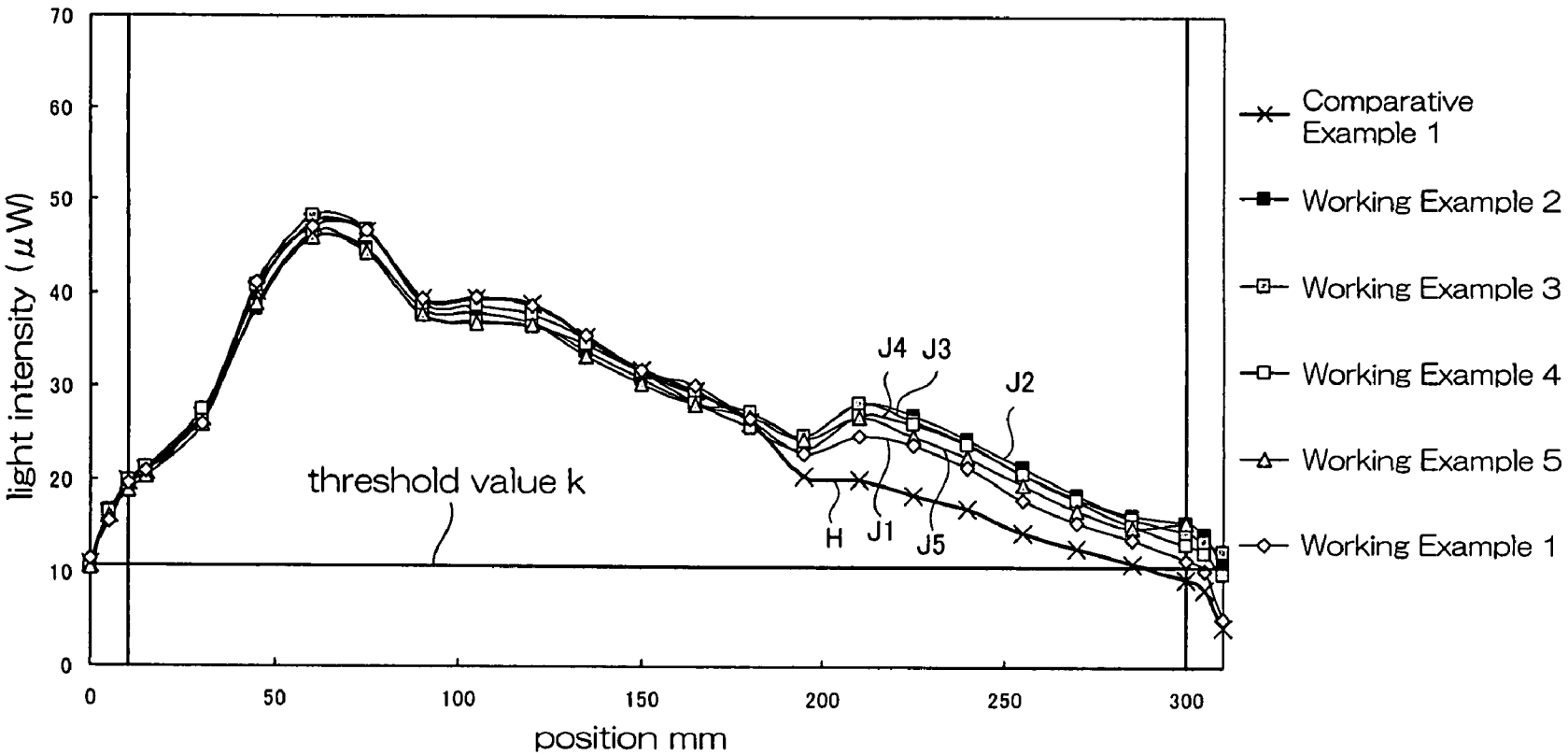
FIG. 24 is a graph showing the results of measuring the light intensity distribution of each of Working Example 1 to 5 of the present invention.

FIG. 24 is a graph showing the light intensity distribution characteristics of the light that is irradiated from the light emitting face 112*b* when light is incident on the light incident face 112*a* of the light guiding member 112 from the LED lamp 111, wherein the horizontal axis indicates the distance from the LED lamp 111 to the irradiated position, and the vertical axis indicates light intensity. Furthermore, FIG. 25 is a graph showing standardized characteristics of Comparative Example 1 and Working Examples 1 to 5, taking the light intensity distribution characteristics of Comparative Example 1 as the standard.

Figure 25:
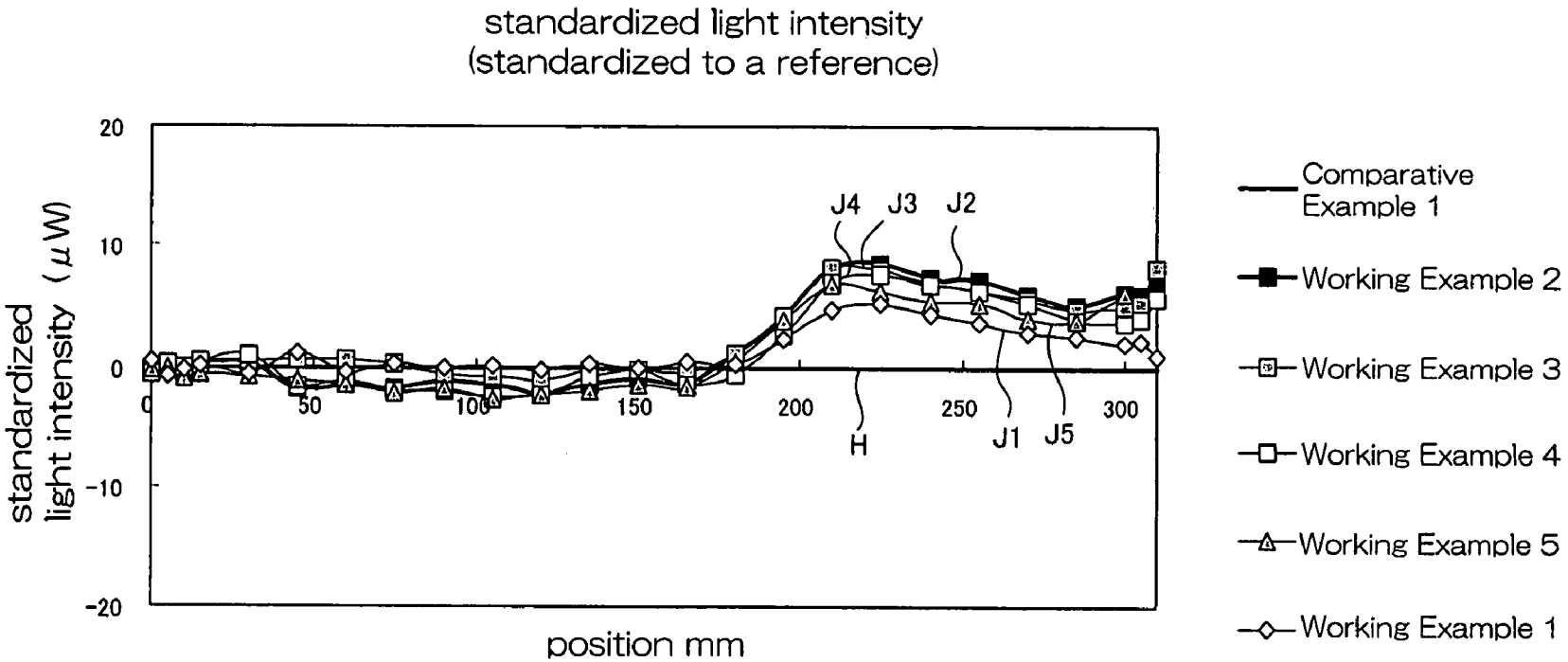
FIG. 25 is a graph showing standardized light intensity distribution characteristics of FIG. 24.
Figure 26:
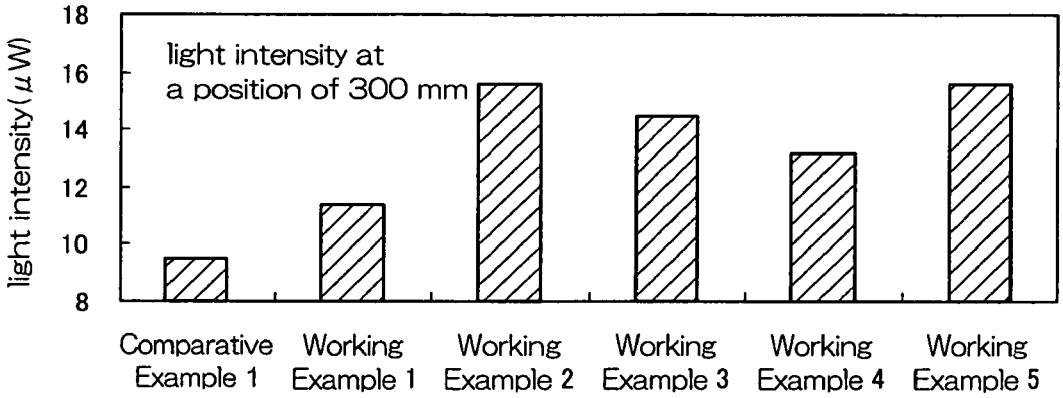
FIG. 26 is a column graph showing the light intensity distribution from each LED of Comparative Example 1 and Working Examples 1 to 5, in the vicinity of a length of 300 mm.

In the graphs of FIG. 24 and FIG. 25, the light intensity distribution characteristics of Comparative Example 1 are shown by H, the light intensity distribution characteristics of Working Example 1 are shown by J1, the light intensity distribution characteristics of Working Example 2 are shown by J2, the light intensity distribution characteristics of Working Example 3 are shown by J3, the light intensity distribution characteristics of Working Example 4 are shown by J4, and the light intensity distribution characteristics of Working Example 5 are shown by J5.

Furthermore, in the graphs of FIG. 24 and FIG. 25, the distance of 10 mm to 300 mm on the horizontal axis corresponds to the image forming region of the photosensitive drum 11, and the vicinity of the distance of 300 mm is proximate to the rear end portion of the light guiding member 112. In the image forming region, provided that the intensity of the light that is irradiated from the light guiding member 112 is at least a threshold value k (shown in FIG. 24), then the light guiding member 112 can sufficiently remove the charge from the photosensitive drum, and it is possible to obtain high quality images without image inconsistencies or the like.

Moreover, FIG. 18 is a column graph showing the light intensity in the vicinity of the distance of 300 mm, separated into Comparative Example 1 and Working Examples 1 to 5.

As is clear from the graphs of FIG. 16 to FIG. 18, in the light intensity distribution characteristics H of Comparative Example 1, and in any one of the light intensity distribution characteristics J1 to J5 of Working Examples 1 to 5, the maximum light intensity is obtained in the range of the distance of 50 mm to 100 mm, and beyond this, the intensity steadily decreases with increasing distance.

Then, for the light intensity distribution characteristics H of Comparative Example 1, the light intensity decreases to less than the threshold value k in the vicinity of the distance of 300 mm, that is to say in the vicinity of the rear end portion of the light guiding member 112. Accordingly, if the light guiding member 112 of Comparative Example 1 is used, then the electric charge cannot be sufficiently removed from the photosensitive drum 11 in the vicinity of the distance of 300 mm, thus generating image inconsistencies.

For the light intensity distribution characteristics J1 of Working Example 1, the light intensity slightly exceeds the threshold value k even in the vicinity of the distance of 300 mm, that is to say in the vicinity of the rear end portion of the light guiding member 112. Therefore, if the light guiding member 112 of Working Example 1 is used, then it is possible to remove the electric charge on the photosensitive drum 11 even in the vicinity of the distance of 300 mm, and image inconsistencies and the like will not occur.

Moreover, for the light intensity distribution characteristics J2 to J5 of Working Examples 2 to 5, the light intensity adequately exceeds the threshold value k even in the vicinity of the distance of 300 mm, that is to say, even in the vicinity of the rear end portion of the light guiding member 112. Thus, if the light guiding member 112 of Working Examples 2 to 5 is used, then the electric charge on the photosensitive drum 11 will be reliably removed even in the vicinity of the distance of 300 mm, and thus image inconsistencies and the like will not occur.

As is clear from such a comparison of Comparative Example 1 and Working Examples 1 to 5, the light intensity in the vicinity of the rear end portion of the light guiding member 112 increases when the reflecting film is pasted onto the upper face in the vicinity of the rear end portion of the light guiding member 112, when the V-shaped groove 112*f* is formed in the vicinity of the rear end portion of the light guiding member 112, onto which the reflecting film 113 is pasted, and when the inclined face 112*i* is formed on the rear end portion of the light guiding member 112, onto which the reflecting film 113 is pasted. Thus, it is possible to reliably remove the electric charge from the photosensitive drum 11 even in the vicinity of the distance of 300 mm.

Next, in the light guiding member 2102 according to Embodiment 5, shown in FIG. 13, in a similar manner to the examples of Embodiments 1 to 4 described above, as shown in FIG. 20A the thickness of the light guiding member 2102*c* was set to 3 mm and the length of the diffusing reflecting face 2102 to 300 mm, the height (height of the light guiding member) H of the diffusing reflecting face 2102*c* to the light emitting face 2102*b* was set to a constant (H=8 mm) from the front end portion (X=0) of the diffusing reflecting face 2102*c* to X=125 mm, and was changed (decreased) at a constant rate in a range of 8 mm to 4.2 mm, over a region from the position of X=125 to the rear end portion of the diffusing reflecting face 2102*c* (X=300 mm). Moreover, as shown in FIG. 20B, the width W of the diffusing reflecting face 2102*c* was changed (reduced) at a constant rate in a range of 4.5 mm to 3 mm over the region from the front end portion of the diffusing reflecting face 2102*c* (X=0) to X=50 mm, and was changed (increased) in a pattern as shown in FIG. 20B in a range of 3 to 4 mm from the position of X=50 mm to the rear end portion of the diffusing reflecting face 2102*c* (X=300 mm).

In the aforementioned light guiding member 2102, the rear end face 2102*e* is taken to be an optically transparent face, and the light guiding member 2102 is set in a state as shown in FIG. 15 and FIG. 16 to arrange the reflecting face 2151*a* behind the rear end face 2102*e* of the light guiding member 2102. Then, a state in which the rear end face 2102*e* of the guiding body 2102 is in contact with the reflecting face 2151*a* of the reflecting member 2150 (gap=0 mm) was taken to be Working Example 6, and states in which the gap between the rear end face 2102*e* of the light guiding member 2102 was 0.5 mm, 1 mm and 2 mm respectively were taken to be Working Example 7 (gap=0.5 mm), Working Example 8 (gap=1 mm) and Working Example 9 (gap=2 mm). The reflecting face 2151*a* was formed by pasting the reflecting film (polycarbonate film on which aluminum vapor deposition has been performed) 2151 onto the opposing face 2150*a* of the reflecting member 2150.

On the other hand, in the aforementioned light guiding member 2102, Comparative Example 2 is taken to be one in which no process is performed in the vicinity of the rear end portion at all. Furthermore, Comparative example 3 is taken to be one in which end portion processing (cutting the end portion) is performed on the rear end portion of the aforementioned light guiding member 2102, and on which mylar (a Tetoron film on which aluminum vapor deposition has been performed) is pasted onto the rear end face after processing as the reflecting film.

Figure 27:
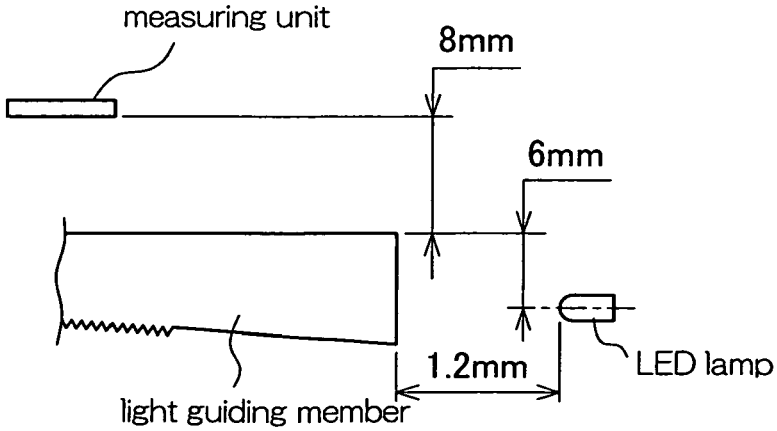
FIG. 27 is a view showing a configuration of a light intensity distribution measurement system, and is a view showing the arrangement of the LED lamp and the measuring unit.

The light intensity distribution of irradiating light when light was irradiated onto the light incident face of the light guiding member from the LED lamp was measured for the light guiding bodies of the aforementioned Working Examples 5 to 9 and Comparative Examples 2 and 3. The results are shown as a graph in FIG. 28. It should be noted that the measurement of the light intensity distribution was performed with the positional relationships of the LED lamp, the light guiding member and the measurement device arranged as shown in FIG. 27. Furthermore, the graph of FIG. 28 shows only the range of the distances from 240 mm to 310 mm.

Figure 28:
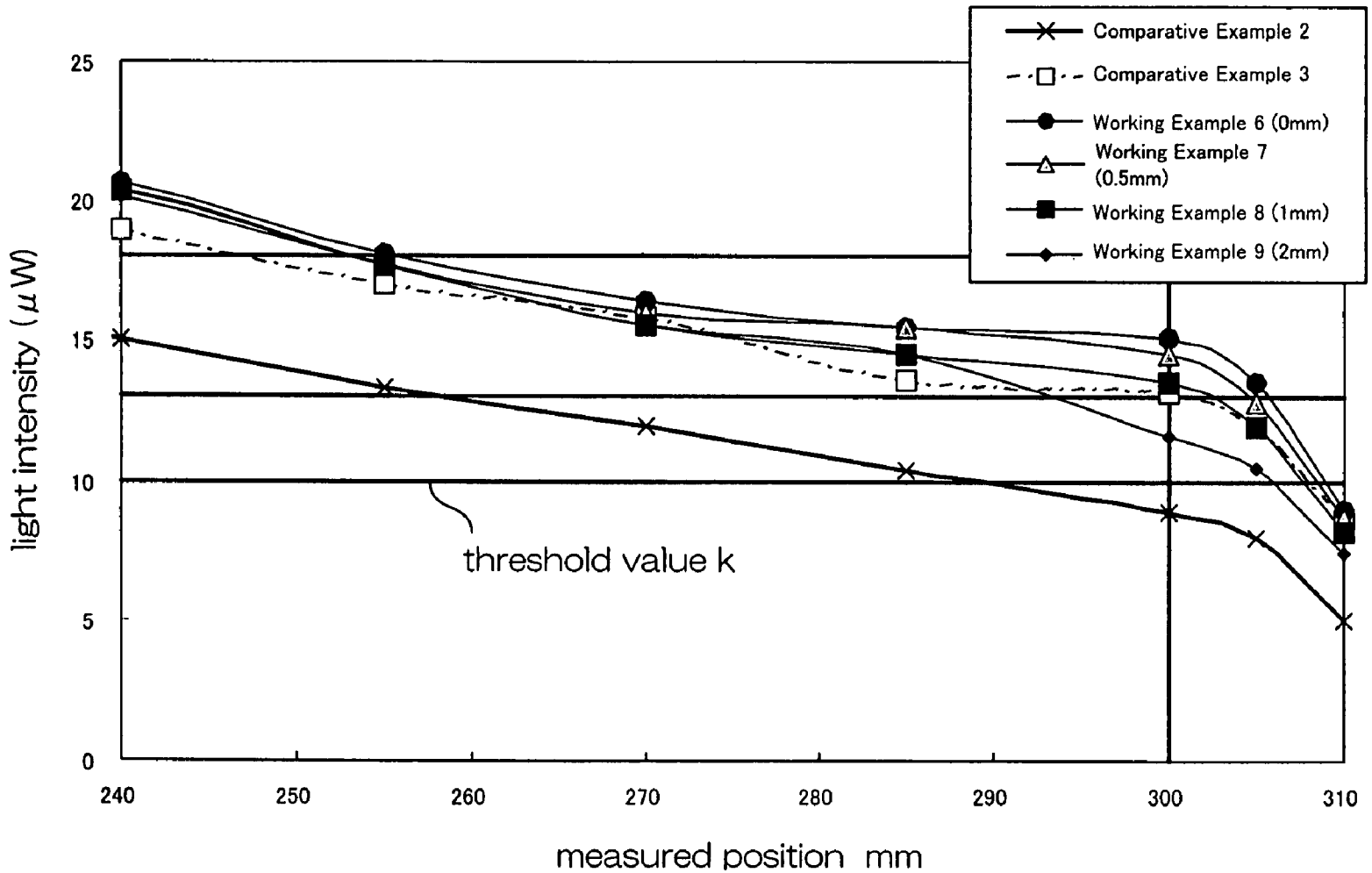
FIG. 28 is a graph showing the result of measuring the light intensity distribution of the Working Examples and the Comparative Examples of the present invention.
Figure 29:
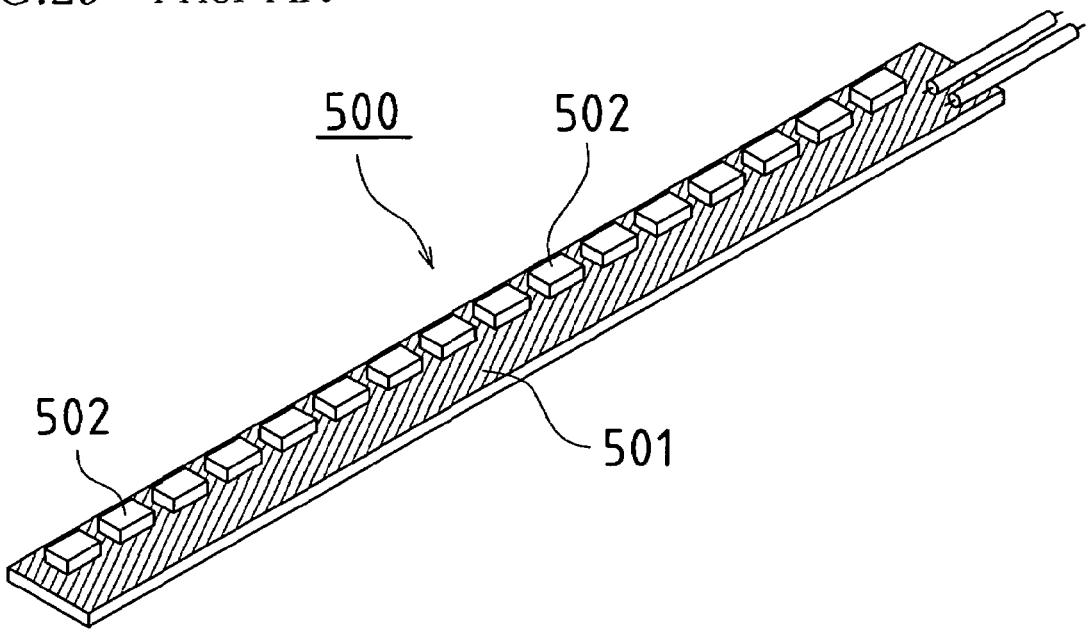
FIG.29 Prior Art
FIG. 29 is a perspective view showing a configuration of an LED array used in a conventional optical discharge apparatus.
Figure 30:
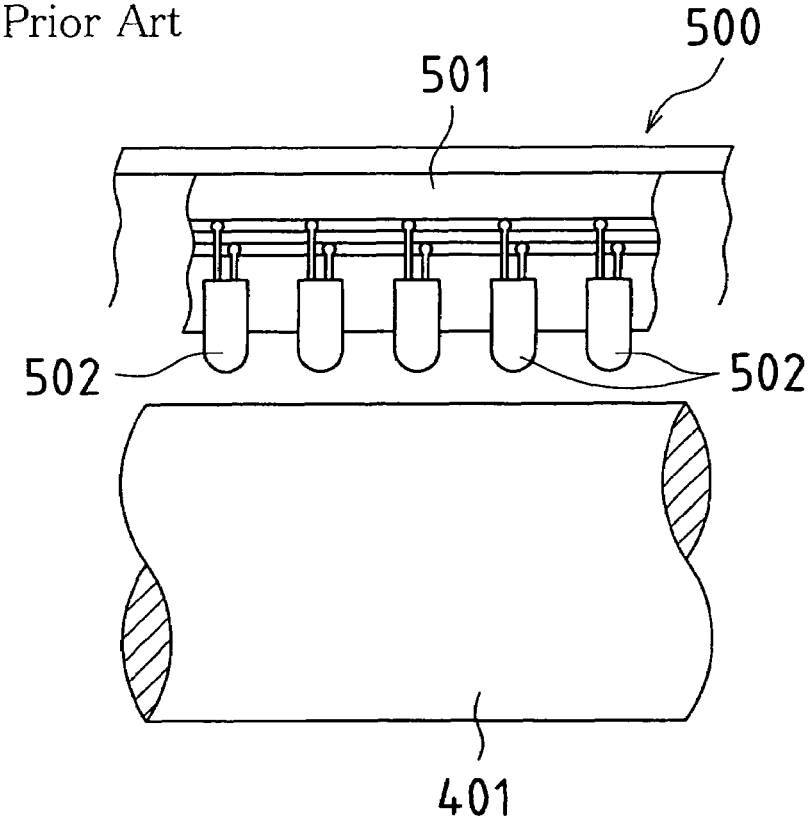
FIG.30 Prior Art
FIG. 30 is a lateral view showing a configuration of a conventional optical discharge apparatus.

In the graph of FIG. 28, the range up to 300 mm on the horizontal axis corresponds to the image forming region of the photosensitive drum 23, and the vicinity of the length of 300 mm corresponds to the vicinity of the rear end portion of the light guiding member. In the image forming region of the photosensitive drum 23, if the intensity of the light that is irradiated from the light guiding member is at least the threshold value k, then the electric charge on the photosensitive drum 23 can be sufficiently removed, and it is possible to obtain high quality images that have no image inconsistencies, for example.

As is clear from the graph in FIG. 28 above, for the light intensity distribution of Comparative Example 2, the light intensity decreased to less than the threshold value in the vicinity of the length of 300 mm, that is to say, in the vicinity of the rear end portion of the light guiding member. Consequently, in the configuration of Comparative Example 2, the electric charge could not be sufficiently removed from the photosensitive drum 23 in the vicinity of the length of 300 mm, and image inconsistencies, and the like, were generated.

By comparison, for the light intensity distribution of Working Example 9 the intensity slightly exceeded the threshold value in the vicinity of the length of 300 mm, that is to say in the vicinity of the rear end portion of the light guiding member 2102. Consequently, by employing the configuration of Working Example 9, the electric charge could be removed from the photosensitive drum 23 even in the vicinity of the length of 300 mm, and no image inconsistencies, or the like, were generated. Moreover, for the light intensity distribution in Working Examples 6 to 8, the light intensity adequately exceeded the threshold value k in the vicinity of the length of 300 mm, that is to say, in the vicinity of the rear end portion of the light guiding member 2102. Consequently by employing the configuration of Working Examples 6 to 8, it is possible to remove the electric charge from the photosensitive drum 23 in the vicinity of the length of 300 mm, without generating image inconsistencies and the like.

Furthermore, in Working Examples 6 to 8, the light intensity in the vicinity of the length of 300 mm was greater than the light intensity of Working Example 3 (in the vicinity of the length of 300 mm), and thus, it can be seen that the method of arranging the reflecting face behind the rear end face of the light guiding member in a separated state is capable of achieving a higher reflectance than the method whereby the reflecting film is pasted on to the rear end face of the light guiding member.

Of the aforementioned measured results of Working Examples 6 to 9, a value R, being the light intensity at the length of 300 mm standardized with respect to the intensity (at the length of 300 mm) of Comparative Example 2, is shown in Table 1 below. Furthermore, of the aforementioned measured results of Working Examples 1 to 5, the value R, being the light intensity at the length of 300 mm standardized with respect to the intensity (at the length of 300 mm) of Comparative Example 2, is shown in Table 2 below.

TABLE 1

| | R |
|---|---|
| Comparative Example 2 | 1 |
| Working Example 6 | 1.7 |
| Working Example 7 | 1.63 |
| Working Example 8 | 1.52 |
| Working Example 9 | 1.3 |

TABLE 2

| | R |
|---|---|
| Comparative Example 2 | 1 |
| Working Example 1 | 1.2 |
| Working Example 2 | 1.66 |
| Working Example 3 | 1.52 |
| Working Example 4 | 1.39 |
| Working Example 5 | 1.64 |

In the aforementioned Table 1 and Table 2, it can be seen that when Working Examples 1 to 9 are compared, Working Examples 6 to 9 achieve an equal or better effect (effect of increasing light intensity of the rear end portion) than Working Examples 1 to 5. Moreover, with Working Examples 6 to 9, it is not necessary perform any processing of the rear end portion of the elongated light guiding member itself, such as pasting the reflecting film onto the upper face in the vicinity of the rear end portion of the light guiding member, forming a V-shaped groove in the vicinity of the rear end portion of the light guiding member to paste the reflecting film, or forming an inclined face on the rear end portion of the light guiding member to paste the reflecting film, as in Working Examples 1 to 5. Thus, in the case of Working Examples 6 to 9, by providing a structure for arranging the reflecting face separated behind the rear end face of the light guiding member, the amount of light that is irradiated onto the photosensitive drum from the vicinity of the rear end portion of the light guiding member can be increased, and it is possible to make the distribution of light that is irradiated onto the photosensitive drum more uniform.

From the above description, the present invention is capable of being used effectively, in an electrographic image forming process, as an optical discharge apparatus for removing a residual electric charge on a photoreceptor by the irradiation of light, and for improving the uniformity of the light distribution of irradiated light that irradiates the photoreceptor for the purpose of removing an electric charge from the photoreceptor in an image forming device, such as a copier machine that contains the optical discharge apparatus.

The present invention can be embodied and practiced in other different forms without departing from the gist and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An optical discharge apparatus used for removing an electric charge on a photoreceptor in an electrographic image forming apparatus, the optical discharge apparatus comprising:

a light guiding member arranged facing the photoreceptor; and a light source for irradiating light onto a light incident face of the light guiding member, wherein a diffusing reflecting face for reflecting the light from the light source toward the photoreceptor is formed on the light guiding member, and the height of the diffusing reflecting face to the light emitting face for emitting light from the light guiding member onto the photoreceptor and the width of the diffusing reflecting face, change in accordance with distance from the light source;

wherein a reflecting member is arranged on an upper face in the vicinity of an end portion of the light guiding member, and wherein the reflecting member reflects light that leaks from the diffusing reflecting face; and wherein the reflecting member is provided over the diffusing reflecting face only in the vicinity of the end portion of the light guiding member which is remote from the light source, wherein the end portion of the light guiding member where the reflecting member is located is thinner than an end portion of the light guiding member proximate the light source.

2. The optical discharge apparatus of claim 1, wherein a groove that cuts across the light guiding member is formed on an upper face in the vicinity of an end portion of the light guiding member.

3. The optical discharge apparatus according to claim 2, wherein the reflecting member is arranged on the upper face in the vicinity of the end portion of the light guiding member, and on an interior face of the groove that cuts across the light guiding member.

4. The optical discharge apparatus of claim 1, wherein the end portion of the light guiding member has a steep inclined face.

5. The optical discharge apparatus according to claim 4, wherein the reflecting member is arranged on the upper face in the vicinity of the end portion of the light guiding member, and on the steep inclined face.

6. The optical discharge apparatus according to claim 1, wherein the light guiding member is folded, and a reflecting face is provided for bending the optical path of the light guiding member at the folding location of the light guiding member.

7. An image forming apparatus in which image forming portions that each include a photoreceptor are aligned in tandem, wherein any one of the optical discharge apparatuses according to claim 1 is attached to each of the photoreceptors.

8. The optical discharge apparatus of claim 1, wherein the light-emitting face is smooth.

* * * * *